US009430886B2

(12) United States Patent
Yano et al.

(10) Patent No.: US 9,430,886 B2
(45) Date of Patent: Aug. 30, 2016

(54) DRIVING DIAGNOSIS DEVICE, DRIVING DIAGNOSIS SYSTEM AND DRIVING DIAGNOSIS METHOD

(71) Applicant: FUJITSU LIMITED, Kawasaki-shi, Kanagawa (JP)

(72) Inventors: Katsutoshi Yano, Kawasaki (JP); Jun Kawai, Kawasaki (JP); Toshiaki Ando, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/294,589

(22) Filed: Jun. 3, 2014

(65) Prior Publication Data

US 2014/0365070 A1 Dec. 11, 2014

(30) Foreign Application Priority Data

Jun. 6, 2013 (JP) ..... 2013-120241

(51) Int. Cl.
*G07C 5/08* (2006.01)

(52) U.S. Cl.
CPC ..... *G07C 5/0808* (2013.01)

(58) Field of Classification Search
CPC ..... G07C 5/0808
USPC ..... 701/33.4
See application file for complete search history.

(56) References Cited

U.S. PATENT DOCUMENTS 7,079,927 B1 * 7/2006 Tano et al. ..... 701/29.6
8,868,288 B2 * 10/2014 Plante et al. ..... 701/32.2
8,930,231 B2 * 1/2015 Bowne et al. ..... 705/4
2005/0125148 A1 * 6/2005 Van Buer et al. ..... 701/209
2008/0122603 A1 * 5/2008 Plante et al. ..... 340/439
2010/0209891 A1 * 8/2010 Lin ..... G09B 19/167 434/66
2011/0153532 A1 * 6/2011 Kuge et al. ..... 706/12
2011/0210867 A1 * 9/2011 Benedikt ..... 340/905
2013/0335213 A1 * 12/2013 Sherony ..... G08G 1/167 340/439
2014/0058579 A1 * 2/2014 Ono ..... G06F 17/00 701/1

FOREIGN PATENT DOCUMENTS

JP 2000-185676 7/2000
JP 2009-23562 2/2009
JP 2009023562 A * 2/2009

OTHER PUBLICATIONS

English translation of JP 2009023562 A.*

* cited by examiner

*Primary Examiner* — Mussa A Shaawat
*Assistant Examiner* — Yazan Soofi
(74) *Attorney, Agent, or Firm* — Fujitsu Patent Center

(57) ABSTRACT

A driving diagnosis device includes storage device which stores plural pieces of advice and a processor. The processor makes a diagnosis on driving by a driver according to vehicle information indicating at least one of behavior of a certain vehicle and an operation of the driver while the driver is driving the certain vehicle. The processor judges a degree of influence, on the diagnosis, of a driving experience of the driver before the driver drives the certain vehicle according to history information as for a history of the driver driving one or more different vehicles including the certain vehicle. And the processor determines to present to the driver a piece of advice stored in the storage device, from among plural pieces of advice, in association with a combination of a result of the diagnosis and the judged degree of influence.

14 Claims, 11 Drawing Sheets

301

DRIVING RECORD TABLE

| DATE AND TIME | LATITUDE [° ] | LONGITUDE [° ] | MOVED DISTANCE [m] | SPEED [km/h] | ACCELERA -TION [G] | YAW RATE [° /sec] | ... |
|---|---|---|---|---|---|---|---|
| 2013/5/20 12:10:00 | 35.580154 | 139.642453 | - | 0 | 0.01 | 0.0 | ... |
| ... | ... | ... | ... | ... | ... | ... | ... |
| 2013/5/20 12:15:30 | 35.581925 | 139.642566 | 0.5 | 10 | -0.02 | 0.0 | ... |
| ... | ... | ... | ... | ... | ... | ... | ... |

302

VEHICLE TABLE

| | |
|---|---|
| VEHICLE IDENTIFIER | ID |
| TOTAL WIDTH | CW |
| VEHICLE WEIGHT | Weight |
| ENGINE OUTPUT CAPABILITY | Pperform |
| STEERING WHEEL PERFORMANCE | Hperform |

FIG. 4

303-1

VEHICLE TABLE

| | |
|---|---|
| VEHICLE IDENTIFIER | ID |
| TOTAL WIDTH | CW |
| VEHICLE WEIGHT | Weight |
| ENGINE OUTPUT CAPABILITY | Pperform |
| STEERING WHEEL PERFORMANCE | Hperform |

303-2

303-P 304-1

DRIVING HISTORY TABLE

| | |
|---|---|
| DRIVING HISTORY NUMBER | Num |
| VEHICLE IDENTIFIER | ID |
| DRIVING TIME | TimePeriod |
| DRIVING START DATE AND TIME | StartTime |
| PRIOR DIAGNOSIS RESULT ON WHEEL OPERATION | DiagRes(1) |
| PRIOR DIAGNOSIS RESULT ON RUNNING POSITION | DiagRes(2) |
| PRIOR DIAGNOSIS RESULT ON SUDDEN ACCELERATION | DiagRes(3) |

304-2

304-Q

305

STATISTICAL TABLE

| | |
|---|---|
| NUMBER OF TIMES OF TRANSFER | Cnt |

F I G. 5

306-j

| ADVICE TABLE ON j-TH DIAGNOSIS ITEM | | |
|---|---|---|
| DIAGNOSIS RESULT | DEGREE OF INFLUENCE | ADVICE |
| $1 \leq Res(j) \leq 3$ | $Inf(j) \leq -n(j)$ | Adv(j,1,1) |
| | $-n(j) < Inf(j) \leq -m(j)$ | Adv(j,1,2) |
| | $-m(j) < Inf(j) < 0$ | Adv(j,1,3) |
| | $Inf(j) = 0$ | Adv(j,1,4) |
| | $0 < Inf(j) < m(j)$ | Adv(j,1,5) |
| | $m(j) \leq Inf(j) < n(j)$ | Adv(j,1,6) |
| | $n(j) \leq Inf(j)$ | Adv(j,1,7) |
| $4 \leq Res(j) \leq 7$ | $Inf(j) \leq -n(j)$ | Adv(j,2,1) |
| | $-n(j) < Inf(j) \leq -m(j)$ | Adv(j,2,2) |
| | $-m(j) < Inf(j) < 0$ | Adv(j,2,3) |
| | $Inf(j) = 0$ | Adv(j,2,4) |
| | $0 < Inf(j) < m(j)$ | Adv(j,2,5) |
| | $m(j) \leq Inf(j) < n(j)$ | Adv(j,2,6) |
| | $n(j) \leq Inf(j)$ | Adv(j,2,7) |
| $8 \leq Res(j) \leq 10$ | $Inf(j) \leq -n(j)$ | Adv(j,3,1) |
| | $-n(j) < Inf(j) \leq -m(j)$ | Adv(j,3,2) |
| | $-m(j) < Inf(j) < 0$ | Adv(j,3,3) |
| | $Inf(j) = 0$ | Adv(j,3,4) |
| | $0 < Inf(j) < m(j)$ | Adv(j,3,5) |
| | $m(j) \leq Inf(j) < n(j)$ | Adv(j,3,6) |
| | $n(j) \leq Inf(j)$ | Adv(j,3,7) |

FIG. 6

401

| | | DIFFERENCE IN WHEEL PERFORMANCE | | | | |
|---|---|---|---|---|---|---|
| | | HperformMin − HperformMax | … | 0 | … | HperformMax − HperformMin |
| NUMBER OF TIMES OF TRANSFER | CntFew | cHndl(1, 1) | … | cHndl(1, k) | … | cHndl(1, H) |
| | … | … | … | … | … | … |
| | CntMany | cHndl(C, 1) | … | cHndl(C, k) | … | cHndl(C, H) |

402

| | | DIFFERENCE IN WHEEL PERFORMANCE | | | | |
|---|---|---|---|---|---|---|
| | | HperformMin − HperformMax | … | 0 | … | HperformMax − HperformMin |
| NUMBER OF TIMES OF TRANSFER | CntFew | cCnt(1, 1) | … | cCnt(1, k) | … | cCnt(1, H) |
| | … | … | … | … | … | … |
| | CntMany | cCnt(C, 1) | … | cCnt(C, k) | … | cCnt(C, H) |

F I G. 1 0

307-j

| ADVICE TABLE ON j-TH DIAGNOSIS ITEM | | | |
|---|---|---|---|
| DIAGNOSIS RESULT | INFLUENCE DEGREE | PRIOR DIAGNOSIS RESULT | ADVICE |
| 1 ≤ Res(j) ≤ 3 | Inf(j) ≤ -n(j) | 1 ≤ Prev(j) ≤ 3 | Adv(j,1,1,1) |
| | | 4 ≤ Prev(j) ≤ 7 | Adv(j,1,1,2) |
| | | 8 ≤ Prev(j) ≤ 10 | Adv(j,1,1,3) |
| | -n(j) < Inf(j) ≤ -m(j) | 1 ≤ Prev(j) ≤ 3 | Adv(j,1,2,1) |
| | | 4 ≤ Prev(j) ≤ 7 | Adv(j,1,2,2) |
| | | 8 ≤ Prev(j) ≤ 10 | Adv(j,1,2,3) |
| | -m(j) < Inf(j) < 0 | 1 ≤ Prev(j) ≤ 3 | Adv(j,1,3,1) |
| | | 4 ≤ Prev(j) ≤ 7 | Adv(j,1,3,2) |
| | | 8 ≤ Prev(j) ≤ 10 | Adv(j,1,3,3) |
| | Inf(j) = 0 | UNDEFINED | Adv(j,1,4,1) |
| | | 1 ≤ Prev(j) ≤ 3 | Adv(j,1,4,2) |
| | | 4 ≤ Prev(j) ≤ 7 | Adv(j,1,4,3) |
| | | 8 ≤ Prev(j) ≤ 10 | Adv(j,1,4,4) |
| | 0 < Inf(j) < m(j) | 1 ≤ Prev(j) ≤ 3 | Adv(j,1,5,1) |
| | | 4 ≤ Prev(j) ≤ 7 | Adv(j,1,5,2) |
| | | 8 ≤ Prev(j) ≤ 10 | Adv(j,1,5,3) |
| | m(j) ≤ Inf(j) < n(j) | 1 ≤ Prev(j) ≤ 3 | Adv(j,1,6,1) |
| | | 4 ≤ Prev(j) ≤ 7 | Adv(j,1,6,2) |
| | | 8 ≤ Prev(j) ≤ 10 | Adv(j,1,6,3) |
| | n(j) ≤ Inf(j) | 1 ≤ Prev(j) ≤ 3 | Adv(j,1,7,1) |
| | | 4 ≤ Prev(j) ≤ 7 | Adv(j,1,7,2) |
| | | 8 ≤ Prev(j) ≤ 10 | Adv(j,1,7,3) |
| 4 ≤ Res(j) ≤ 7 | ..... | ..... | ..... |
| 8 ≤ Res(j) ≤ 10 | ..... | ..... | ..... |

FIG. 11

DRIVING DIAGNOSIS DEVICE, DRIVING DIAGNOSIS SYSTEM AND DRIVING DIAGNOSIS METHOD

CROSS-REFERENCE TO RELATED APPLICATION

This application is based upon and claims the benefit of priority of the prior Japanese Patent Application No. 2013-120241, filed on Jun. 6, 2013, the entire contents of which are incorporated herein by reference.

FIELD

The embodiments discussed herein are related to the technology of diagnosing the driving of a vehicle.

BACKGROUND

Various techniques (for example, a technique of diagnosing the driving of a vehicle) have been studied to support the driving of a vehicle.

For example, proposed is an operation management system capable of analyzing for each driver the tendency of the operation of a driver by efficiently detecting the dangerous behavior of a vehicle. The operation management system includes a sensor unit, a recorder unit, and a behavior analysis device.

The sensor unit detects the behavior of a vehicle in a time series. The recorder unit records on a memory card the behavior detected by the sensor unit. The behavior analysis device sets a condition pattern for judging the behavior of a vehicle as a dangerous behavior. To be more concrete, the recorder unit compares the condition pattern for recognising the behavior of a vehicle as a dangerous behavior with the behavior practically detected by the sensor unit. Then, the recorder unit records on a memory card for each dangerous behavior only the information related to the behavior which is adapted to the condition pattern so that the behavior analysis device may statistically analyze the recorded information.

In addition, the following advice providing system has been proposed to provide appropriate advice to a user who drives a plurality of vehicles. The advice providing system includes a vehicle information acquisition device and an advice providing control device. The vehicle information acquisition device acquires the information about the vehicle to be driven by a user. The advice providing control device controls providing advice for a user based on the comparison between the following information.

Information acquired by the vehicle information acquisition device about the vehicle to be currently driven by a user Information acquired by the vehicle information acquisition device when a user drives a vehicle different from the currently driven vehicle.

Furthermore, the documents such as Japanese Laid-open Patent Publication No. 2000-185676, Japanese Laid-open Patent Publication No. 2009-23562, etc. are well known.

SUMMARY

According to an aspect of the embodiment, a driving diagnosis device includes storage device which stores plural pieces of advice and a processor.

The processor makes a diagnosis on driving by a driver according to vehicle information indicating at least one of behavior of a certain vehicle and an operation of the driver while the driver is driving the certain vehicle. The processor judges a degree of influence, on the diagnosis, of a driving experience of the driver before the driver drives the certain vehicle according to history information as for a history of the driver driving one or more different vehicles including the certain vehicle. And the processor determines to present to the driver apiece of advice stored in the storage device, from among plural pieces of advice, in association with a combination of a result of the diagnosis and the judged degree of influence.

The object and advantages of the invention will be realized and attained by means of the elements and combinations particularly pointed out in the claims.

It is to be understood that both the foregoing general description and the following detailed description are exemplary and explanatory and are not restrictive of the invention.

BRIEF DESCRIPTION OF DRAWINGS

FIG. 4 illustrates examples of a driving record table and a vehicle table stored in a vehicle information storage unit;

FIG. 5 illustrates examples of a vehicle table, a driving history table, and a statistical table;

FIG. 6 illustrates an example of an advice table stored in an advice storage unit;

FIG. 10 is an example of a coefficient table; and

FIG. 11 is an example of an advice table according to the seventh embodiment.

DESCRIPTION OF EMBODIMENTS

The driving of a driver who is driving a certain vehicle may be affected by the experience of the previous driving of the driver on the certain vehicle, or the experience of the previous driving of the driver on other vehicles. Therefore, if advice is provided for a driver according to the current driving without considering the history of the driving of the driver, then the advice may be inappropriate for the driver.

An aspect of the following embodiments aims at providing a driver with more appropriate advice. According to the following embodiments, more appropriate advice may be provided for a driver.

The embodiments are described below in detail with reference to the attached drawings. The description is performed in the following order.

Figure 1:
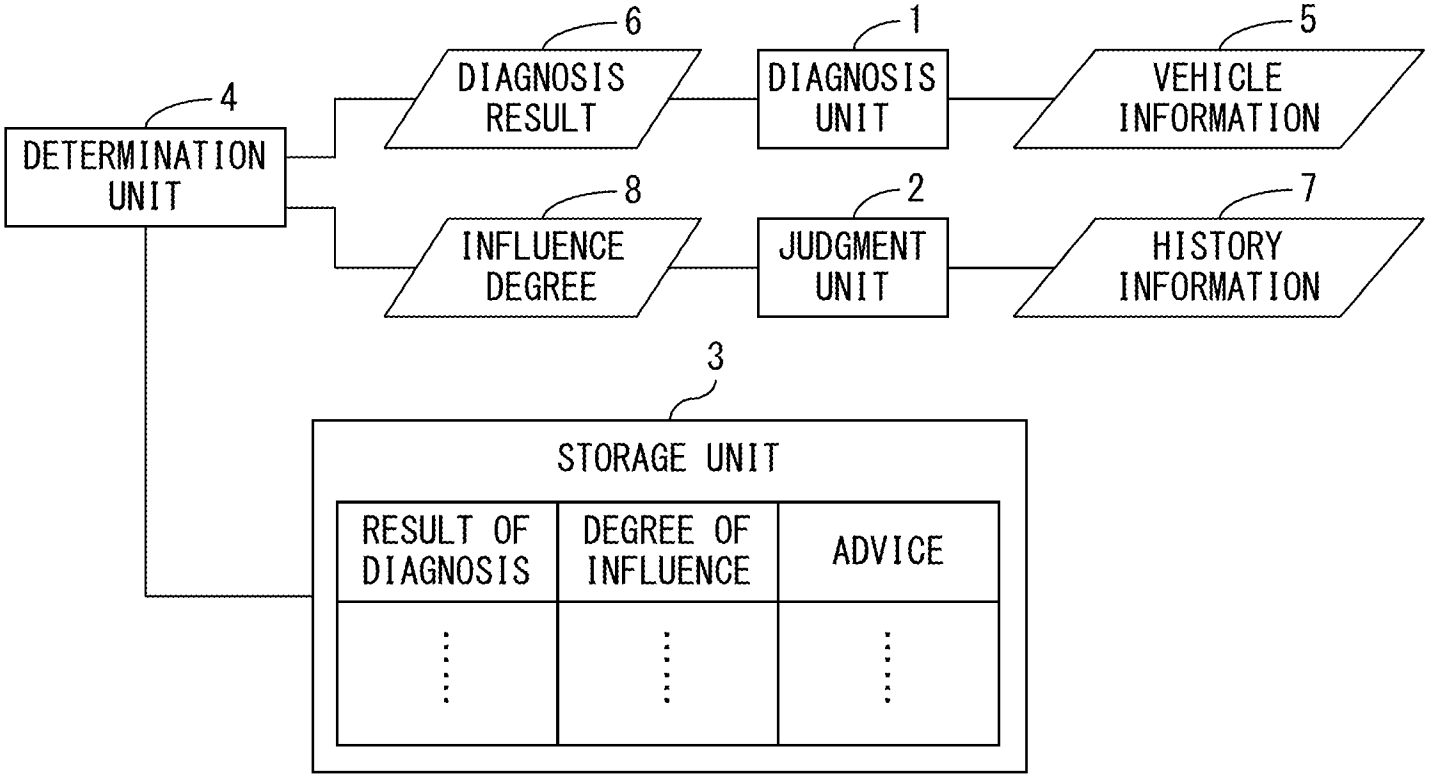
FIG. 1 is an explanatory view of the first embodiment.

The first embodiment is described first with reference to FIG. 1. Next, the configuration of the device used in the second embodiment is described with reference to FIGS. 2 and 3. Then, examples of various types of data used in the second embodiment are described, and some processes performed in the second embodiment are described with reference to FIGS. 7 through 9. Described next are other embodiments.

FIG. 1 is an explanatory view of the first embodiment. FIG. 1 illustrates a diagnosis unit 1, a judgment unit 2, a storage unit 3, and a determination unit 4.

For example, an onboard device equipped into a vehicle may include the diagnosis unit 1, the judgment unit 2, the storage unit 3, and the determination unit 4. Thus, the onboard device having the diagnosis unit 1, the judgment unit 2, the storage unit 3, and the determination unit 4 is an example of a driving diagnosis device. The driving diagnosis device may be realized by a general-purpose computer.

On the other hand, another device which communicates information with the onboard device over a network (hereafter referred to as a management device for convenience of explanation below) may include the diagnosis unit 1, the judgment unit 2, the storage unit 3, and the determination unit 4. From a certain point of view, a management device which includes the diagnosis unit 1, the judgment unit 2, the storage unit 3, and the determination unit 4 is a component of a driving diagnosis system including an onboard device and a management device.

The diagnosis unit 1, the judgment unit 2, the storage unit 3, and the determination unit 4 may be distributed to the onboard device and the management device in the driving diagnosis system. For example, the onboard device may include the diagnosis unit 1, and the management device may include the judgment unit 2, the storage unit 3, and the determination unit 4.

In any case, the diagnosis unit 1 diagnoses the driving of a driver according to vehicle information 5. The vehicle information 5 refers to at least one of the following two matters.

The behavior of a certain vehicle while a driver is driving the certain vehicle (concretely the vehicle into which the onboard device is equipped)

The operation of the driver while the driver is driving the certain vehicle

The diagnosis unit 1 conducts a diagnosis on each of one or more diagnosis items. For example, the diagnosis unit 1 may conduct a diagnosis on each of the following various diagnosis items.

The diagnosis on the way of operating the steering wheel by a driver. For example, the diagnosis on whether the vehicle is turning too much, appropriately turning, or turning insufficiently depending on the degree of the operation of the steering wheel by the driver.

The diagnosis on the position of the vehicle in the lateral direction (that is, in the direction orthogonal to the running direction of the vehicle on the road) when the vehicle is running forward. For example, the diagnosis on whether the vehicle is running close to the right side, running appropriately around the center of the lane, or running close to the left side.

The diagnosis on the operation of the accelerator and/or the brake by the driver. For example, the diagnosis on the degree of the smoothness of the acceleration and/or deceleration of the vehicle.

The diagnosis unit 1 may conduct a diagnosis on the driving of a driver according to the vehicle information 5 at one time point. The diagnosis unit 1 may conduct a diagnosis on the driving of a driver using the vehicle information 5 about each of some time points. The type of the vehicle information 5 used in the diagnosis may depend on the diagnosis item.

The vehicle information 5 about a certain vehicle being driven by a driver may include one or more types of information exemplified below, for example.

A pair of a latitude and a longitude indicating the position of the certain vehicle The speed of the certain vehicle in the running direction The acceleration of the certain vehicle in the running direction The yaw rate of the certain vehicle At least one of the pitch angle, the roll angle, and the yaw angle of the certain vehicle The output of the engine of the certain vehicle The turning angle of each tire of the certain vehicle Furthermore, the vehicle information 5 may include not only the above-mentioned information indicating the behavior of the certain vehicle, but also the information about the operation performed by a driver. For example, the vehicle information 5 may include one or more types of information exemplified below.

The steering angle of the certain vehicle

The pedaling force on the accelerator of the certain vehicle

The pedaling force on the brake of the certain vehicle

In the following description, the result of the diagnosis by the diagnosis unit 1 is referred to as a "diagnosis result". The diagnosis unit 1 outputs a diagnosis result 6 for each diagnosis item. Each diagnosis result 6 may be expressed by an ordinary scale, an interval scale, or a ratio scale. Depending on the diagnosis item, the diagnosis result 6 may be expressed by a discrete value or a continuous value.

Providing a driver with appropriate advice depending on the diagnosis result 6 is useful in supporting the driving of a driver. However, the advice simply based only on the diagnosis result 6 may be inappropriate for a driver at times for the following reason.

A way of a driver who is driving a certain vehicle may be affected by a driving experience of the driver before the driver starts driving a certain vehicle. Therefore, the diagnosis result 6 may also be affected by the driving experience of the driver. For example, the experience of the driver having driven one or more vehicles other than the certain vehicle may affect the diagnosis result 6.

The degree of influence may depend on various factors. Concretely, the driver may be positively or negatively affected by his or her experience. In addition, the magnitude of the degree of influence may also depend on various factors. When the degree of influence is numerically expressed, the magnitude of influence refers to the absolute value of the degree of influence.

The experience of the driver having driven other one or more vehicles may also outstandingly affect the current driving of the driver positively or negatively. On the other hand, the influence of the driving experience (that is, the bias caused by the driving experience) may be zero (or almost zero).

Depending on the degree of influence from the driving experience of the driver on the current driving, the diagnosis result 6 as the evaluation on the current driving is also affected by the driving experience. Therefore, for example, although the same diagnosis results 6 are obtained on two drivers relating to a certain diagnosis item, different appropriate pieces of advice may be provided for the two drivers.

Fixed advice regardless of the driving experience of each driver may be useful and appropriate for a driver. However, fixed advice regardless of the driving experience of each driver may be redundant and complicated for another driver, and may be wrong for a further driver.

Therefore, in order to present appropriate advice to a driver in the first embodiment, the judgment unit 2, the storage unit 3, and the determination unit 4 are provided.

Concretely, the judgment unit 2 judges the degree of influence of the driving experience (that is, the driving experience of the driver before the driver drives the certain vehicle currently being driven by the driver) on the diagnosis. To be more concrete, the judgment unit 2 judges the degree of influence of the driving experience on the diagnosis according to history information 7. The history information 7 relates to the history of a driver driving one or more different vehicles including the certain vehicle currently being driven by the driver.

The degree of influence judged by the judgment unit 2 is simply referred to as an influence degree. The judgment unit 2 judges an influence degree 8 on each diagnosis item, and outputs the degree.

Note that the influence degree 8 judged by the judgment unit 2 is the degree of the influence provided by the driving experience on the diagnosis while the history information 7 used in making a judgment by the judgment unit 2 is the information about one or more different vehicles including the certain vehicle currently being driven by a driver. That is, in some cases, the judgment unit 2 may judge the influence degree 8 from the history information 7 indicating the certain vehicle currently being driven by the driver without using the history information 7 indicating the history of the driver having driven another vehicle in the history information 7.

For example, when a driver has driven for a sufficiently long time the vehicle currently being driven, the judgment unit 2 may judge that the degree of influence of the experience of the driver having driven another vehicle on the judgment is zero (or almost zero). When the judgment is made, there is a case that the history information 7 about the experience of the driver having driven another vehicle is not acquired.

Although the driver has driven one or more other vehicles, there is a case that the history information 7 about the experience of the driver having driven one or more other vehicles when the above-mentioned judgment is made is not acquired. That is, in the judgment above, it is enough to acquire only the history information 7 indicating the history of when the driver started driving or how long the driver has driven the certain vehicle currently being driven by the driver.

The influence degree 8 may be expressed by an ordinal scale, an interval scale, or a ratio scale. The influence degree 8 may be expressed by a discrete value or a continuous value. Furthermore, the range of the influence degree 8 may be appropriately defined depending on the embodiments. The range of the influence degree 8 may also depend on each diagnosis item. Normalization may be allowed so that a common range of the influence degree 8 may be used. However, as described later with reference to FIG. 6, the normalization is not always performed.

An appropriate advice for a driver depends not only on the diagnosis result 6, but also on the influence degree 8 as described above. Then, the storage unit 3 stores plural pieces of advice for each diagnosis item. Concretely, each piece of advice for a certain diagnosis item is stored in the storage unit 3 in association with a combination of a diagnosis result and an influence degree.

The combination of a diagnosis result and an influence degree may be concretely expressed by the following various methods.

A combination of a value indicating a diagnosis result and a value indicating an influence degree A combination of a value indicating a diagnosis result and a set of values (for example, a range of a value) indicating an influence degree A combination of a set of values (for example, a range of a value) indicating a diagnosis result and a value indicating the degree of influence A combination of a set of values (for example, a range of a value) indicating a diagnosis result and a set of values (for example, a range of a value) indicating the degree of influence (for example, refer to FIGS. 6 through 11 described later)

FIG. 1 illustrates a table which includes the columns of a diagnosis result, an influence degree, and advice which is stored in the storage unit 3. However, a data format other than the table format may be used.

In any data format to be applied, the storage unit 3 stores plural pieces of advice depending on the combination of a diagnosis result and an influence degree. Then, the determination unit 4 determines to present to a driver the advice stored in the storage unit 3 in association with the combination of the diagnosis result 6 (that is, the result of the diagnosis obtained by the diagnosis unit 1) and the influence degree 8 (that is, the influence degree judged by the judgment unit 2).

The above-mentioned judgment unit 2, storage unit 3, and determination unit 4 may select an appropriate advice for each driver depending on not only the diagnosis result 6, but also the influence degree 8. Therefore, the first embodiment has the effect of providing a driver with more appropriate advice. Accordingly, a driver may be appropriately supported according to the first embodiment.

For example, the diagnosis result 6 of a diagnosis item may be expressed by ten levels from 1 to 10, and the level 10 may be the highest evaluation level. For example, assume that the diagnosis result 6 refers to the level 7, there may be the following cases.

For example, it may be estimated that the driver has been positively affected by the driving experience of the driver having driven one or more other vehicles. In this case, it is estimated that the level of the current driving of the driver is 7 at most even with the strong positive influence. Therefore, in this case, there is the possibility that the basic driving ability of the driver is not so high. Therefore, in this case, it is estimated that simple advice appropriate for a beginner will be useful.

On the other hand, it may be estimated that the driver is negatively affected to some extent from the experience of the driver having driven one or more other vehicles. In this case, the current driving of the driver is not lower than the level 7 even with a strong negative influence. Therefore, in this case, it is estimated that the adaptability and the driving ability of the driver are relatively high, but the driving is still to be improved. Accordingly, it is estimated that advanced advice for a driver having somewhat high driving ability is useful.

Otherwise, there may be the case in which the degree of influence is zero or almost zero. To be more concrete, it may be estimated that the driver is not strongly affected by the experience of having driven another vehicle. Furthermore, there may be the case in which since the driver has not been driven other vehicles, there is no influence of the driving experience of other vehicles. In any case, when the influence degree is zero or almost zero, it is estimated that the diagnosis result 6 of "level 7" reflects the driving ability of the driver as is. The level 7 is not a low evaluation, but the driving technique is to be improved. Therefore, in this case, it is estimated that general advice is useful.

Obviously, the range of the value of the diagnosis result 6 may depend on the type of diagnosis item. The larger the value of the diagnosis result 6 is, the higher the evaluation of a diagnosis item may become. Otherwise, the smaller the value of the diagnosis result 6 is, the higher the evaluation of a diagnosis item may become.

Therefore, the concrete method of appropriately changing advice depending on the degree of influence from a driving experience may depend on the type of diagnosis item. Obviously, appropriate advice may also depend on the diagnosis result 6. The storage unit 3 stores in advance appropriate advice depending on the combination of a diagnosis result and an influence degree for each type of diagnosis item. Therefore, according to the first embodiment, the determination unit 4 may select appropriate advice from the storage unit 3.

The onboard device may further include an output unit which outputs advice determined by the determination unit 4 to be presented to a driver. Otherwise, the onboard device may be connected to an external output unit. The output unit may be one of the following units.

A speaker which outputs audio advice

A display which outputs visual advice using characters and/or images

A combination of a speaker and a display

Furthermore, the onboard device may include a control unit which controls the timing with which the output unit output the advice. For example, the control unit may control the timing so that advice may be output while a vehicle is stopped. Depending on the embodiments, the control unit may allow the output unit to output advice while a vehicle is running. However, it is preferable that the control unit controls the output timing so that the output of advice may be avoided while a vehicle is turning right or left. The control unit controls the above-mentioned timing according to the vehicle information 5.

The history information 7 is related to the history of the driver having driven one or more different vehicles including the certain vehicle currently being driven by the driver. More concrete contents of the history information 7 are described below.

The history information 7 may include the following two pieces of vehicle specification information.

First vehicle specification information indicating the specification of the certain vehicle currently being driven by the driver Second vehicle specification information about the specification of a vehicle different from the certain vehicle currently being driven by the driver in one or more vehicles driven by the driver (that is, the specification of other vehicles that have been driven by the driver)

For example, the vehicle specification information may include at least one of the values indicating the vehicle type, the vehicle width, the vehicle height, the vehicle weight, the diameter of tire, the output performance of engine, the handling performance, the position (right or left) of driver seat, etc. When the history information 7 includes the first and second vehicle specification information as described above, the judgment unit 2 may judge the influence degree 8 so that the magnitude of the influence degree 8 may monotonically increase with respect to the magnitude of the difference between the specification indicated by the first vehicle specification information and the specification indicated by the second vehicle specification information. The operation of the judgment unit 2 is based on the consideration that the larger the difference between the vehicle that the driver has driven before and the vehicle that the driver is currently driving is, the more largely the current driving of the driver is positively or negatively affected from the driving experience of the driver.

In the present specification, the term "monotonic increase" refers to monotonically non-decreasing, and the term "monotonic decrease" refers to monotonically non-increasing.

For example, the vehicle specification information may include the value of the vehicle width. In this case, the judgment unit 2 may judge the influence degree 8 so that the absolute value of the influence degree 8 may monotonically increase with respect to the absolute value of the difference between the width of the vehicle currently being driven by the driver and the width of the vehicle which has been driven before by the driver. The judgment unit 2 may judge the influence degree 8 as described above by calculating the influence degree 8 using an appropriate monotonic function.

The judgment unit 2 judges the influence degree 8 for each diagnosis item according to the vehicle specification information depending on the diagnosis item. That is, which type of the vehicle information 5 is used for the diagnosis unit 1, and which type of vehicle specification information is used in judging the influence degree 8 depend on the diagnosis item.

The judgment unit 2 may also judge the influence degree 8 using the coefficient for determination as to whether the influence degree 8 is positive or negative when the difference between the specification of the first vehicle specification information and the specification of the second vehicle specification information is positive. A concrete example of the coefficient is exemplified in the equations (1), (3), and (4) described later.

Furthermore, the degree of the adaptation of a driver to the certain vehicle currently being driven by the driver is affected by a certain temporal factor. The value directly or indirectly indicating the temporal factor may be included in the history information 7.

In this case, the judgment unit 2 may extract or calculate from the history information 7 the value indicating the temporal factor. The judgment unit 2 may judge the influence degree 8 using an extracted or calculated value. The temporal factors are listed below.

The time length from the start of driving the certain vehicle currently being driven by the driver The elapse of time of driving another vehicle in the past other than the vehicle currently being driven by the driver The elapse of time from the end of driving a vehicle other than the vehicle currently being driven by the driver The case in which a driver is not yet much adapted to the certain vehicle currently being driven by the driver is, in other words, the case in which the driving experience of a driver much affects the diagnosis result 6 positively or negatively. On the other hand, the case in which a driver is already much adapted to the certain vehicle currently being driven by the driver is, in other words, the case in which the driving experience of a driver does not much affect the diagnosis result 6 positively or negatively. Therefore, the judgment unit 2 may judge the influence degree 8 (that is, the degree of influence of the driving experience of a driver on the diagnosis result 6) using the value indicating the above-mentioned temporal factor.

Described below is more concrete explanation on the operation of the judgment unit 2 based on the above-mentioned temporal factor.

For example, the history information 7 may include the starting time information indicating the time when a driver starts driving the certain vehicle currently being driven by the driver. In this case, the judgment unit 2 judges the influence degree 8 so that the magnitude of the influence degree 8 may monotonically decrease with respect to the length of the elapse of the time from the time indicated by the starting time information. The operation of the judgment unit 2 is based on the following consideration.

The driver gets used to the current vehicle with the lapse of time from the start of the driver driving the vehicle currently being driven by the driver.

The more the driver gets used to the current vehicle, the less the direct influence from the driving experience of other vehicles on the current driving of the driver is (regardless of positive or negative).

The history information 7 may include the driving time information indicating the length of time in which the driver drives a vehicle other than the certain vehicle currently being driven by the driver. In this case, the judgment unit 2 may judge the influence degree 8 so that the magnitude of the influence degree 8 may monotonically increase with respect to the length of time indicated by the driving time information. The operation of the judgment unit 2 is based on the consideration that the longer the driving time of the driver, the larger the magnitude of the influence from the experience of the driver having driven another vehicle is (regardless of positive or negative influence). The driving time information may include the information indicating the stating time at which the driver starts driving the other vehicle, and the information indicating the ending time at which the driver ends driving the other vehicle.

Furthermore, the history information 7 may also include the ending time information indicating the time at which the driver has ended driving the other vehicle than the certain vehicle currently being driven by the driver. In this case, the judgment unit 2 judges the influence degree 8 so that the magnitude of the influence degree 8 may monotonically decrease with respect to the length of the elapse of the time from the time indicated by the ending time information. The operation of the judgment unit 2 is based on the consideration that the influence from the driving experience of a driver decreases with the lapse of time (regardless of positive or negative influence).

The history information 7 may include the number-of-vehicle information about the number of one or more different vehicles (including the certain vehicle currently being driven by the driver) which have been driven by a driver.

When the number of vehicles indicated by the number-of-vehicle information is 1, the judgment unit 2 judges the influence degree 8 as zero because, for a driver who has not driven any other vehicle, there is no influence from the driving experience. On the other hand, when the number of vehicles indicated by the number-of-vehicle information is larger than 1, the judgment unit 2 judges the influence degree so that the magnitude of the influence degree 8 may monotonically decrease with respect to the number of vehicles indicated by the number-of-vehicle information.

The operation of the judgment unit 2 described above is based on the consideration that the more experienced a driver becomes in driving various vehicles, the more experienced a driver becomes in total driving, and the adaptability of the driver will be improved. That is, the operation of the judgment unit 2 above is based on the consideration that the higher the adaptability of a driver is, the less the influence of the features of each vehicle becomes directly on the driver. Refer to the equation (13) described later for a concrete example of the above-mentioned judgment according to the number-of-vehicle information.

As clearly described above, the number of vehicles indicated by the number-of-vehicle information is an example of a factor which affects the degree at which a driver is adapted to the certain vehicle currently being driven by the driver.

Obviously, the history information 7 may include two or more pieces of various information as exemplified above. Then, the judgment unit 2 may judge the influence degree 8 depending on the combination of two or more types of information included in the history information 7.

For example, the history information 7 may include both of starting time information and driving time information. In this case, the judgment unit 2 judges the influence degree 8 so that the magnitude of the influence degree 8 may monotonically decrease with respect to the length of the elapse of the time from the time indicated by the starting time information, and so that the magnitude of the influence degree 8 may monotonically increase with respect to the length of the time indicated by the driving time information.

In FIG. 1, the storage unit 3 stores each piece of advice in association with the combination of a diagnosis result and an influence degree. However, plural pieces of advice may be prepared in smaller granularity. Concretely, the storage unit 3 may store each piece of advice in association with the diagnosis result, the influence degree, and the prior diagnosis result.

In this case, the history information 7 may include the prior diagnosis result obtained when the driver drove a vehicle other than the certain vehicle currently being driven by the driver.

For example, an onboard device including the diagnosis unit 1, the judgment unit 2, the storage unit 3, and the determination unit 4 may be equipped into each vehicle. When the onboard device is equipped into each vehicle, a prior diagnosis result is available. For example, the diagnosis result 6 output from the diagnosis unit 1 of an onboard device may be written to a storage medium, and then other onboard device may read the diagnosis result 6 as a prior diagnosis result from the storage medium.

Otherwise, as described above, the diagnosis unit 1 may be included in a management device. The diagnosis unit 1 included in the management device may concurrently conduct a diagnosis on a plurality of drivers who are driving a plurality of vehicles. When the diagnosis unit 1 is included in the management device, a prior diagnosis result is available.

In any case, when a prior diagnosis result is available, the determination unit 4 determines that the advice stored in the storage unit 3 in association with the following three combinations is presented to the driver.

The diagnosis result 6 obtained by the diagnosis unit 1 on the current driving The influence degree 8 judged by the judgment unit 2

The prior diagnosis result included in the history information 7

The history information 7 may be stored in a portable computer-readable storage medium (for example, a semiconductor memory card etc.). Otherwise, the history information 7 may be stored in an information storage device. The information storage device may be, for example, a non-volatile storage device (for example, an HDD (hard disk drive) or an SSD (solid-state drive)) provided for a management device.

For example, the onboard device may concretely be a driving diagnosis device including the diagnosis unit 1, the judgment unit 2, the storage unit 3, and the determination unit 4. In this case, the driving diagnosis device may further include a read unit and a write unit. The read unit reads the history information 7 from a storage medium which stores the history information 7 (concretely the history information 7 about each vehicle which the driver has driven in the past). The write unit writes to the storage medium the history information 7 about the driving of the certain vehicle currently being driven by the driver.

For example, the card reader/writer for semiconductor memory card may be used as the read unit and the write unit. The "reader/writer" means a "reader and writer". When USB (universal serial bus) memory is used as a storage medium, an USB interface may be used as a read unit and a write unit. The USB interface includes concretely a USB port, a USB controller, and a bus of a USB standard.

Otherwise, the driving diagnosis device including the diagnosis unit 1, the judgment unit 2, the storage unit 3, and the determination unit 4 may include a receiving unit and a transmission unit. The receiving unit receives the history information 7 from an information storage device which stores the history information 7 (concretely the history information 7 about each vehicle which the driver has driven in the past)

over a network. The transmission unit transmits the history information 7 about the driving of the certain vehicle currently being driven by the driver to the information storage device over the network.

For example, a WLAN (wireless local area network) interface may be used as a receiving unit and a transmission unit. Otherwise, a wireless communication circuit in accordance with a wireless communication standard such as the 3GPP (3rd (third) Generation Partnership Project), the LTE (Long Term Evolution), the WiMAX (worldwide interoperability for microwave access), etc. may be used as a receiving unit and a transmission unit. Furthermore, the WiMAX is a registered trademark.

As described above, each of the diagnosis unit 1, the judgment unit 2, the storage unit 3, and the determination unit 4 may be included in the onboard device or the management device. In a driving diagnosis system including both of the onboard device and the management device, it is preferable that the onboard device includes at least the acquisition unit and the first transmission/receiving unit described below.

An acquisition unit which acquires the vehicle information 5 from the certain vehicle currently being driven by the driver. For example, the ECU (Electronic Control Unit) which acquires an output value used as the vehicle information 5. Otherwise, a general-purpose computer etc. which acquires the vehicle information 5 from a sensor or an ECU. That is, an acquisition unit is realized by any processor because the ECU includes a processor such as a micro-controller etc., and a computer also includes a processor.

A first transmission/receiving unit which performs communications with a management device over a network. For example, a WLAN interface, a wireless communication circuit in accordance with an appropriate wireless communication standard etc.

Furthermore, in the driving diagnosis system including both the onboard device and the management device, it is preferable that the management device includes at least the second transmission/receiving unit and the history storage unit.

A second transmission/receiving unit which performs communications with an onboard device over a network. For example, a cable LAN (Local Area Network) interface, a WLAN interface, or a wireless communication circuit in accordance with an appropriate wireless communication standard etc.

A history storage unit which stores the history information 7 about the history of the driver driving a vehicle other than the certain vehicle currently being driven by the driver by the driver. For example, an HDD, an SSD, or a combination of them.

In the driving diagnosis system which includes both of the above-mentioned onboard device and management device, the onboard device and the management device may communicate with each other over a network. Therefore, the diagnosis unit 1 may be included either in the onboard device or the management device.

The history information 7 about the history of the driver driving the certain vehicle currently being driven by the driver may be generated or acquired by the onboard device. On the other hand, the history information 7 about the driving history is stored in the history storage unit as described above. Since the onboard device and the management device may communicate with each other, the onboard device may recognize the history information 7 about both devices, and the management device may also recognize the history information 7 of both devices.

Therefore, the judgment unit 2 which makes a judgment according to the history information 7 may also be included either in the onboard device or the management device. The judgment unit 2 judges the influence degree 8 using at least one of the history information 7 about the certain vehicle currently being driven by the driver and the history information 7 about the driving history.

The history information 7 generated or acquired by the onboard device about the certain vehicle currently being driven by the driver is transmitted from the first transmission/receiving unit to the management device over a network. Then, the management device receives the history information 7 by the second transmission/receiving unit, and adds the received history information 7 to the history information 7 stored in the history storage unit. Thus, the history storage unit stores the history information 7 about each vehicle driven by the driver.

The storage unit 3 also may be included either in the onboard device or the management device. Similarly, the determination unit 4 may be included in any of the onboard device and the management device.

In the driving diagnosis system including both the above-mentioned onboard device and management device, for example, all of the diagnosis unit 1, the judgment unit 2, the storage unit 3, and the determination unit 4 may be included in the onboard device. In this case, the history information 7 stored in the history storage unit is transmitted from the first transmission/receiving unit of the management device over a network, received by the first transmission/receiving unit of the onboard device, and acquired by the judgment unit 2.

On the other hand, all of the diagnosis unit 1, the judgment unit 2, the storage unit 3, and the determination unit 4 may be included in the management device. In this case, the vehicle information 5 obtained by the acquisition unit of the onboard device is transmitted from the first transmission/receiving unit of the onboard device over a network, received by the second transmission/receiving unit of the management device, and acquired by the diagnosis unit 1. Then, the advice which the determination unit 4 has determined to present is transmitted from the second transmission/receiving unit over a network, and received by the first transmission/receiving unit of the onboard device. In this case, the onboard device may includes an output unit for outputting advice, and may be connected to an output unit. In any case, the advice received by the onboard device is output from the output unit. As a result, the driver may recognize the advice.

Furthermore, the diagnosis unit 1, the judgment unit 2, the storage unit 3, and the determination unit 4 may be distributed to the onboard device and the management device. In any case, the onboard device includes or is connected to the output unit. Therefore, the driver may recognize the advice. Then, since the advice recognized by the driver is appropriate advice selected by the determination unit 4 based on not only the diagnosis result 6 but also the influence degree 8, it is useful for the driver.

Then, the second embodiment is described with reference to FIGS. 2 through 9. The second embodiment corresponds to the case in which the diagnosis unit 1, the judgment unit 2, the storage unit 3, and the determination unit 4 in FIG. 1 corresponds to the driving diagnosis device as an onboard device. Also in the explanation below, for example, a reference numeral in FIG. 1 such as the "history information 7" may be used.

Figure 2:
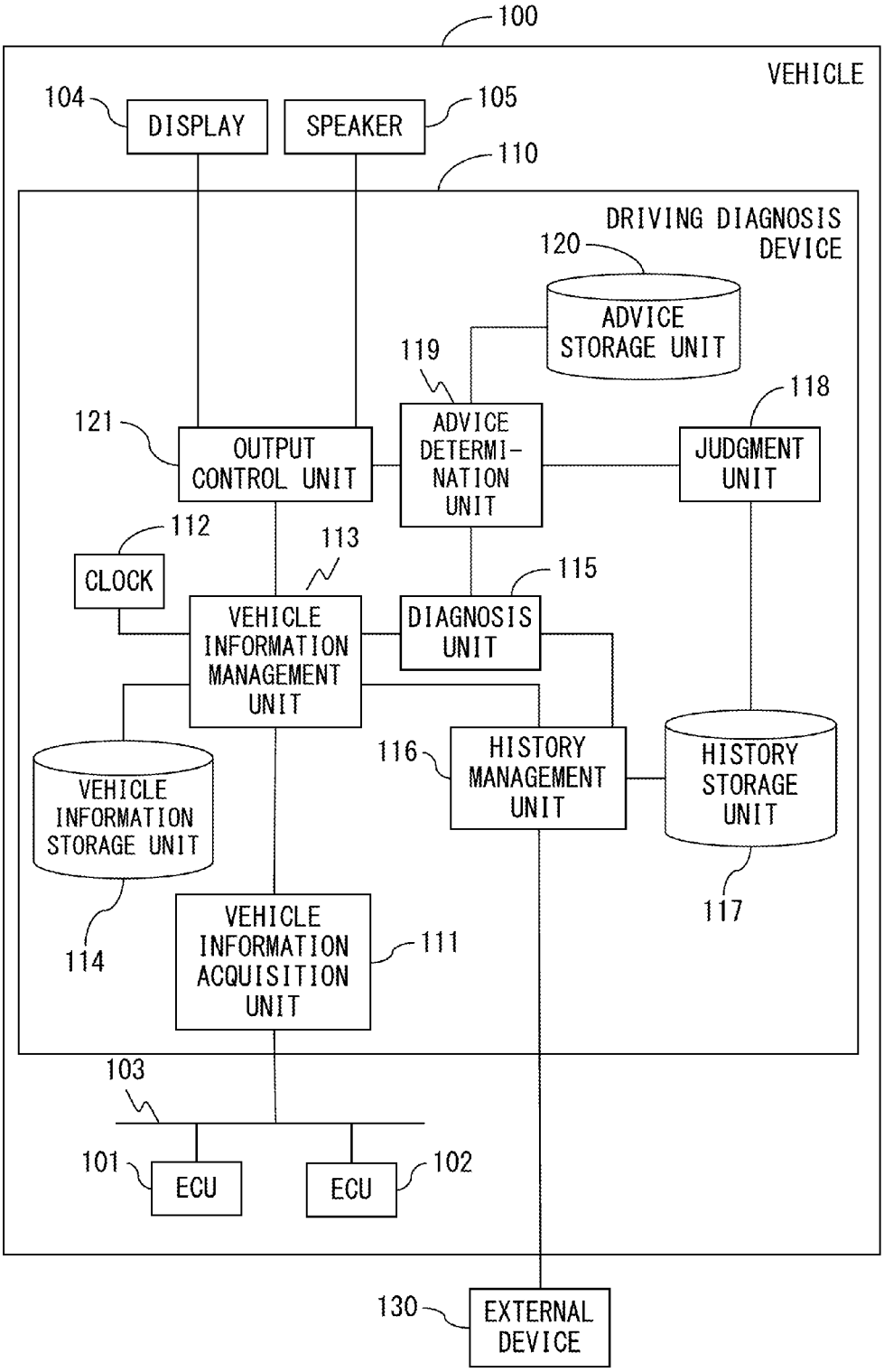
FIG. 2 is a block diagram of a driving diagnosis device.

FIG. 2 is a block diagram of the driving diagnosis device according to the second embodiment.

A vehicle 100 includes some ECUs. For convenience of explanation below, two ECUs 101 and 102 are exemplified in FIG. 2. Each ECU is connected to a CAN (Controller Area Network) 103. In some embodiments, a network other than a CAN may be used in the vehicle 100.

Each ECU may be directly connected to a sensor (for example, an acceleration sensor etc.), or may be connected to a sensor through the CAN 103. When a sensor is directly connected to an ECU, the ECU may notifies another component (for example, another ECU etc.) of the value read from the sensor through the CAN 103. Furthermore, the ECU may read a value output by the sensor connected to the CAN 103 through the CAN 103.

Furthermore, at least one of a display 104 and a speaker 105 is equipped into the vehicle 100. The display 104 is an example of an output unit which visually outputs advice using characters and/or images etc. The speaker 105 is an example of an output unit which outputs advice by voice.

A driving diagnosis device 110 is equipped into the vehicle 100. The driving diagnosis device 110 includes a vehicle information acquisition unit 111, a clock 112, a vehicle information management unit 113, a vehicle information storage unit 114, a history management unit 116, a history storage unit 117, a judgment unit 118, an advice determination unit 119, an advice storage unit 120, and an output control unit 121.

The relationship between FIGS. 1 and 2 is described below.

The diagnosis unit 115 corresponds to the diagnosis unit 1, the judgment unit 118 corresponds to the judgment unit 2, the advice storage unit 120 corresponds to the storage unit 3, and the advice determination unit 119 corresponds to the determination unit 4.

The vehicle information 5 is acquired by the vehicle information acquisition unit 111 in FIG. 2, managed by the vehicle information management unit 113, and stored in the vehicle information storage unit 114. Then, the vehicle information 5 is output to the diagnosis unit 115 and the history management unit 116.

The diagnosis result 6 in FIG. 1 is output from the diagnosis unit 115 to both the history management unit 116 and the advice determination unit 119 in FIG. 2.

The history information 7 in FIG. 1 is managed by the history management unit 116, and stored in the history storage unit 117. The history information 7 about the driving history is acquired from an external device 130 in FIG. 2. Then, the history information 7 about the driving of the current vehicle 100 is output by the history management unit 116 to the external device 130 for use in the future.

The influence degree 8 in FIG. 1 is output from the judgment unit 118 in FIG. 2 to the advice determination unit 119.

The details of the driving diagnosis device 110 in FIG. 2 are described below.

As illustrated in FIG. 2, the vehicle information acquisition unit 111 is connected to the CAN 103. The vehicle information acquisition unit 111 acquires the vehicle information 5 through the CAN 103. For example, the vehicle information acquisition unit 111 may acquire the vehicle information 5 from the sensor connected to the CAN 103 through the CAN 103, and may acquire the vehicle information 5 through the CAN 103.

According to some embodiments, the vehicle information acquisition unit 111 may be connected to a sensor and/or an ECU through a signal line. In this case, the vehicle information acquisition unit 111 may acquire the vehicle information 5 from the sensor and/or the ECU through a signal line. Furthermore, not only the ECU, but also a car navigation system and/or a onboard camera may be connected to the CAN 103. The vehicle information acquisition unit 111 may acquire the vehicle information 5 from a car navigation system and/or an onboard camera through the CAN 103.

Obviously, the driving diagnosis device 110 itself may also function as a car navigation system. For example, the driving diagnosis device 110 may include a GPS (Global Positioning System) sensor, and the GPS sensor may be connected to the vehicle information acquisition unit 111.

An example of the vehicle information 5 acquired by the vehicle information acquisition unit 111 is described below.

The information about the behavior of the vehicle 100 (for example, an acceleration, a vehicle speed, a rudder angle, the rotation rate or an engine, the operation state of a brake, the state of a winker, the roll angle, the pitch angle, and the yaw angle of the vehicle 100, etc.)

The information about the operation of a driver (for example, the steering angle, the pedaling force of an accelerator, the pedaling force of a brake, etc.)

The information about the attribute particular to the vehicle 100 (for example, the vehicle identifier, the model, the width, the output performance of the engine, the handling performance, the diameter of tires, the position of the driver seat (right or left in the vehicle)

The image captured by an onboard camera (when the camera is equipped into the vehicle 100. Hereafter referred to as a camera image.)

The position information, the map information, etc. indicating the position of the vehicle 100 (when a car navigation system is equipped into the vehicle 100).

The vehicle information acquisition unit 111 outputs various acquired vehicle information 5 to the vehicle information management unit 113. When the vehicle information management unit 113 acquires the vehicle information 5 from the vehicle information acquisition unit 111, it reads the current time from the clock 112. Then, the vehicle information management unit 113 may store the acquired vehicle information 5 in association with the time information indicating the read current time.

Upon receipt of a request for the vehicle information 5 from the diagnosis unit 115, the vehicle information management unit 113 reads the vehicle information 5 and the time information associated with the vehicle information 5 from the vehicle information storage unit 114. Then, the vehicle information management unit 113 outputs the vehicle information 5 and the time information to the diagnosis unit 115. Simultaneously, upon receipt of a request for the vehicle information 5 from the history management unit 116, the vehicle information management unit 113 reads the vehicle information 5 from the vehicle information storage unit 114, and outputs the vehicle information 5 to the history management unit 116.

The diagnosis unit 115 performs the diagnosing process about various diagnosis items according to the vehicle information 5 and the time information associated with the vehicle information 5. The diagnosis unit 115 acquires the vehicle information 5 with the time information from the vehicle information storage unit 114 through the vehicle information management unit 113, and performs the diagnosing process according to the acquired vehicle information 5 and time information.

The type of vehicle information 5 to be used in the diagnosis may depend on the diagnosis item. Furthermore, whether or not only the vehicle information 5 acquired at one time point is used in the diagnosis, or whether or not plural pieces of vehicle information 5 acquired in a specified length of period are used in the diagnosis may depend on the diagnosis item.

Furthermore, the trigger of the diagnosis may depend on each diagnosis item. For example, the diagnosis on a certain diagnosis item may be periodically performed. On the other hand, the diagnosis on another diagnosis item may be performed when the vehicle 100 performs a particular behavior (for example, the vehicle 100 makes a turn).

For example, a diagnosis item may relate to the smooth operation on the steering wheel of the driver. An example of the vehicle information 5 used in diagnosing the smooth operation on the steering wheel is the information about the rudder angle of a steering wheel (that is, the steering angle), the information about the position of the vehicle 100, etc.

The diagnosis unit 115 conducts a diagnosis based on the position of the vehicle 100 when the operation on the steering wheel is started, the position of the vehicle 100 when the operation on the steering wheel is ended, and the time taken to operate the steering wheel. For example, the diagnosis unit 115 may judge the difference between the practical driving of a driver and the ideal driving, and a diagnosis may be conducted on the smooth operation on the steering wheel based on the judged difference.

Another diagnosis item may relate to an item about smooth acceleration/deceleration. An example of the vehicle information 5 used in diagnosing smooth acceleration/deceleration is acceleration (mainly an acceleration component in the driving direction of the vehicle 100). The lower the acceleration or deceleration is, the better diagnosis result 6 the diagnosis unit 115 may output.

Furthermore, another diagnosis item may be an item relating to the appropriateness of the position of the vehicle 100 (hereafter also referred to as a running position) in the lateral direction while the vehicle 100 is running forward (that is, in the direction orthogonal to the running direction of the vehicle 100 on the road). An example of the vehicle information 5 used for diagnosis on the appropriateness of the running position is, for example, the vehicle width of the vehicle 100, the map information including the information about the width of the lane on which the vehicle 100 is running, the camera image shot by an onboard camera, etc.

For example, the diagnosis unit 115 recognizes the white line which delimits the lanes from the camera image, and estimates the lateral running position of the vehicle 100 on the lane on which the vehicle 100 is running. The diagnosis unit 115 may diagnose the appropriateness of the running position from the estimated running position. Concretely, the closer to the center the estimated running position is, the better diagnosis result 6 the diagnosis unit 115 may output.

The diagnosis unit 115 outputs the diagnosis result 6 on each diagnosis item with an identifier for identification of the diagnosis item (hereafter referred to as a diagnosis item ID) to the advice determination unit 119.

As described above, the diagnosis unit 115 acquires the time information with the vehicle information 5. Therefore, the diagnosis unit 115 may recognize the time elapse from the start of driving the vehicle 100 by the driver (hereafter referred to as a driving time). The diagnosis unit 115 outputs the diagnosis result 6 on each diagnosis item with the information about the driving time and the diagnosis item ID to the history management unit 116.

The history management unit 116 manages the history information 7. Concretely, the history management unit 116 may acquire the history information 7 from the vehicle information management unit 113, acquire another type of history information 7 from the diagnosis unit 115, or acquire a further history information 7 from the external device 130. The history management unit 116 stores the acquired history information 7 in the history storage unit 117. The history storage unit 117 may store the history information 7 in the format illustrated later in FIG. 5.

The external device 130 may be a server 230 in FIG. 3 as described later, and may be a storage medium 240. Furthermore, the history management unit 116 outputs at least a part of the history information 7 in the history storage unit 117 to the external device 130 in preparation for the case in which the driver drives another vehicle (or the driver drives the vehicle 100 again in the future).

Concretely, the history management unit 116 may acquire from the vehicle information management unit 113 the vehicle specification information about the specification of the vehicle 100 currently being driven by the driver (that is, the information about the attribute particular to the vehicle 100) in the history information 7. The vehicle specification information about the vehicle 100 may be stored in the vehicle information storage unit 114 in advance. Otherwise, the vehicle specification information about the vehicle 100 may be, for example, output from any ECU, acquired by the vehicle information acquisition unit 111 through the CAN 103, and stored in the vehicle information storage unit 114. Therefore, the history management unit 116 may acquire from the vehicle information management unit 113 the vehicle specification information about the vehicle 100.

Furthermore, in the history information 7, the history management unit 116 may acquire from the diagnosis unit 115 the information about the history of the driver driving the vehicle 100 (that is, the certain vehicle currently being driven by the driver).

For example, as described above, the diagnosis unit 115 may recognize the length of the elapsed time from the start of driving the vehicle 100 (that is, the driving time). Therefore, the history management unit 116 may acquire from the diagnosis unit 115 the information about the driving time in the history information 7. Furthermore, in preparation for the case in which the driver drives another vehicle in the future (or in the case in which the driver drives the vehicle 100 again in the future), the history management unit 116 may acquire the diagnosis result 6 output by the diagnosis unit 115 as a part of the history information 7 which may be used in the future. To be more concrete, the history management unit 116 may acquire the diagnosis result 6 with the diagnosis item ID.

Furthermore, in the history information 7, the history management unit 116 may acquire from the external device 130 the result of the prior diagnosis obtained when the driver drove another vehicle (or the vehicle 100) in the past. Similarly, the history management unit 116 may also acquire in the history information 7 from the external device 130 the vehicle specification information about another vehicle the driver drove in the past.

Furthermore, the history management unit 116 may acquire from the external device 130 the time information about the driving history in the history information 7. An example of the time information about the driving history is described below.

The date and time in which the driver started driving a certain vehicle (vehicle other than the vehicle 100 or the vehicle 100 itself)

The date and time in which the driver ended driving the certain vehicle

The length of driving time in which the driver drove the certain vehicle in the past Since the driver may intermittently drive one vehicle, the concrete definition of "driving time" may be varied. Some of the definitions of the "driving time" is described later with reference to FIG. 5.

The judgment unit 118 judges the degree of influence of the driving experience of the driver on the diagnosis result 6 (that is, the influence degree 8) using at least a part of various types of history information 7. Concretely, the judgment unit 118 reads the appropriate history information 7 depending on the diagnosis item from the history storage unit 117, and judges the influence degree 8 using the read history information 7.

To be more concrete, according to the second embodiment, when the diagnosis unit 115 outputs the diagnosis result 6 with the diagnosis item ID to the advice determination unit 119, the advice determination unit 119 requests the judgment unit 118 to judge the influence degree 8. At the request, the advice determination unit 119 notifies the judgment unit 118 of the diagnosis item ID.

At the request from the advice determination unit 119, the judgment unit 118 judges the influence degree 8 on the diagnosis item having the notified diagnosis item ID. Then, the judgment unit 118 notifies the advice determination unit 119 of the influence degree 8.

The advice storage unit 120 corresponds to the storage unit 3 in FIG. 1, and stores plural pieces of advice. Each piece of advice is associated with the combination of a diagnosis result and the influence degree.

To be more concrete, the advice storage unit 120 stores plural pieces of advice for each diagnosis item. For example, the advice storage unit 120 may store an advice table described later as illustrated in FIG. 6 on each diagnosis item.

Therefore, with reference to the advice storage unit 120, the advice determination unit 119 may determine the advice presented to the driver. That is, the advice determination unit 119 selects the advice to be presented to the driver from among the plural pieces o advice in the advice storage unit 120 based on the diagnosis item ID and the diagnosis result 6 notified from the diagnosis unit 115, and the influence degree 8 notified from the judgment unit 118. The advice determination unit 119 outputs to the output control unit 121 the advice determined to be presented to the driver as described above.

Upon receipt of the advice from the advice determination unit 119, the output control unit 121 performs the control relating to the output of advice. For example, the output control unit 121 may determine whether or not the driver is to be presented with advice. The output control unit 121 may also determine the timing with which the advice is presented to the driver.

Concretely, the output control unit 121 acquires the vehicle information 5 through the vehicle information management unit 113, and estimates the state of the vehicle 100 from the vehicle information 5. Then, the output control unit 121 determines at least one of whether or not the driver is to be presented with advice and the timing in which the advice is presented to the driver.

For example, if the vehicle 100 is stopped or is running forward at a speed lower than a specified speed, then the output control unit 121 may determine that advice is to be presented immediately. On the other hand, if the vehicle 100 is running at a speed higher than a specified speed or is turning right or left, then the output control unit 121 may determine that advice is not presented, and that the presentation of the advice is postponed.

Depending on the data format of the advice stored in the advice storage unit 120, the output control unit 121 may convert the advice notified from the advice determination unit 119 into the data format so that the advice may be output from the display 104 and/or speaker 105. The data format of each advice in the advice storage unit 120 is optional depending on the embodiments.

For example, each advice may be any of character string data (that is, text data), image data, and audio data. Apiece of advice may be expressed in two or more data formats and the data of each format may be stored in the advice storage unit 120. On the other hand, for example, when advice is expressed in a character string format in the advice storage unit 120, the output control unit 121 may convert the character string data into image data and/or audio data.

The output control unit 121 controls the display 104 and/or speaker 105, and outputs advice to the display 104 and/or speaker 105.

Figure 3:
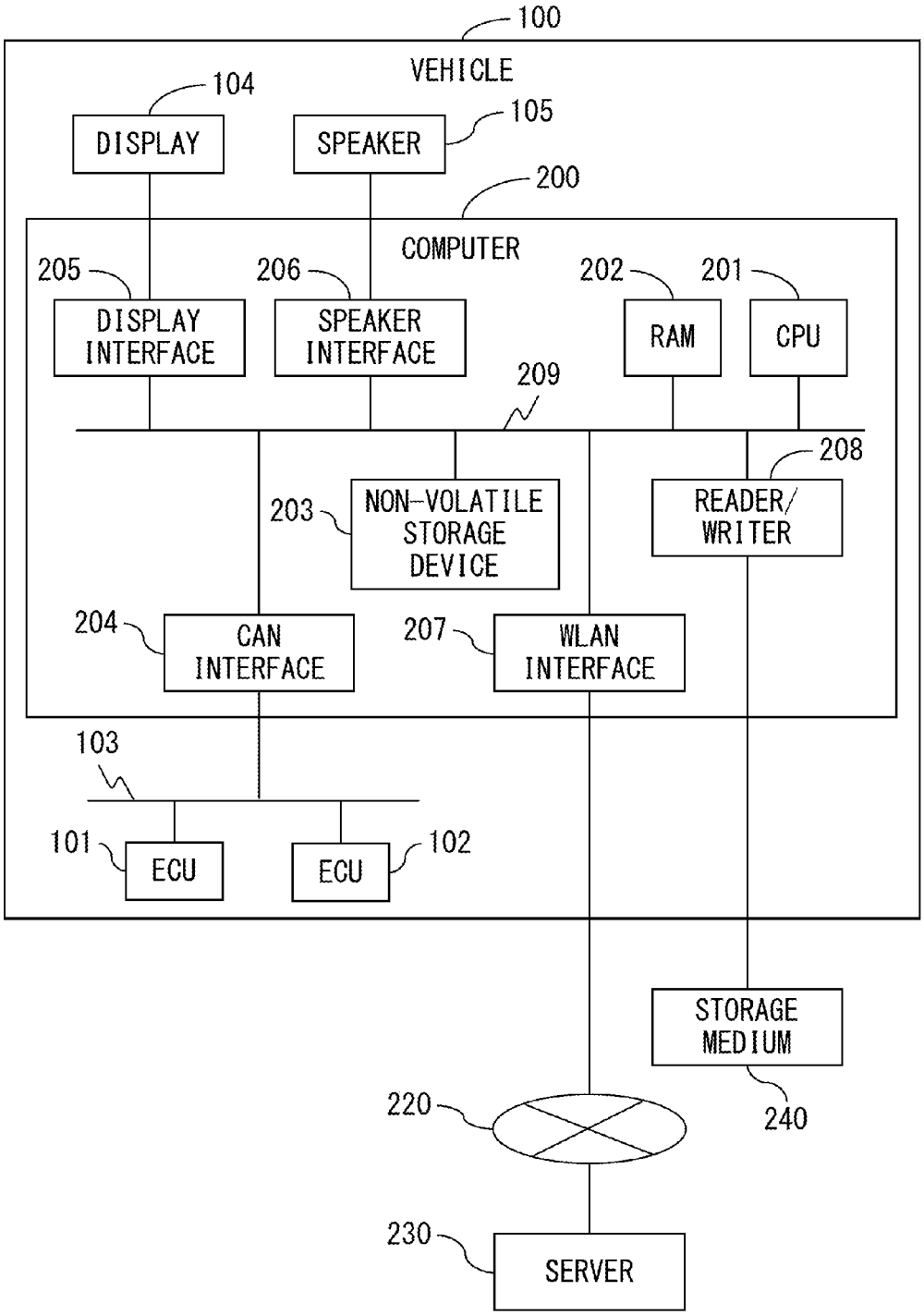
FIG. 3 is a configuration of hardware.

FIG. 3 illustrates a hardware configuration of the computer which realizes the driving diagnosis device 110. The driving diagnosis device 110 in FIG. 2 may be realized by any of the following hardware, but FIG. 3 exemplifies the case in which the driving diagnosis device 110 is realized by a computer 200.

A general-purpose computer which executes a program

A dedicated hardware circuit such as an ASIC (Application-Specific Integrated Circuit) etc.

A configurable circuit such as an FPGA (Field Programmable Gate Array)

A combination of two or more of them

The computer 200 includes a CPU (Central Processing Unit) 201, RAM (Random Access Memory) 202, and a non-volatile storage device 203. The CPU 201 is a single-core or multi-core processor. The computer 200 may include a plurality of processors. The non-volatile storage device 203 is, for example, an HDD, an SSD, or a combination of them. The non-volatile storage device 203 may include ROM (Read Only Memory). The CPU 201 loads a program into the RAM 202, and executes the program using the RAM 202 as a work area.

The computer 200 further includes some following interface circuits.

A CAN interface 204 for connection of the computer 200 to the CAN 103 (concretely, a communication circuit according to a CAN protocol)

A display interface 205 for connection of the computer 200 to the display 104 (for example, a display controller)

A speaker interface 206 for connection of the computer 200 to the speaker 105 (for example, a speaker controller)

A WLAN interface 207 for connection of the computer 200 to a network 220 (concretely, an interface circuit including a communication circuit of a physical layer and a MAC (Media Access Control) sublayer).

A server 230 is also connected to the network 220. Therefore, the computer 200 may communicate information with the server 230 over the network 220. The network 220 may, for example, the Internet. Depending on the type of network 220, the WLAN interface 207 may be replaced with a wireless communication circuit in accordance with the 3GPP, the LTE, the WiMAX, etc. (WiMAX is a registered trademark).

The server 230 is an example of a management device described above with reference to the first embodiment. The server 230 includes a CPU, RAM, a communication device (for example, a cable LAN interface, WLAN interface, or other type of wireless communication circuit), and a storage device (for example, an HDD, an SSD, or a combination of them.

Furthermore, the computer 200 includes a reader/writer 208 for the storage medium 240.

For example, the storage medium 240 may be a semiconductor memory card such as an SD (Secure Digital) card. In this case, the reader/writer 208 is a card reader/writer.

The storage medium 240 may be USB memory. In this case, the reader/writer 208 is a USB interface including a USB controller.

The storage medium 240 may be a disk such as a magnetic disk, a magneto optical disk, an optical disk, etc. In this case, the reader/writer 208 is a disk drive device. An optical disk is, for example, a CD (Compact Disc), and a DVD (Digital Versatile Disc).

Each component in the computer 200 is connected to each other through a bus 209.

One of the display 104 and the speaker 105 may be omitted. When the display 104 is omitted, the display interface 205 may also be omitted. When the speaker 105 is omitted, the speaker interface 206 may also be omitted.

Furthermore, the computer 200 is not always to be provided with both of WLAN interface 207 (or other type of wireless communication circuit) and the reader/writer 208. Concretely, when the external device 130 is the server 230, the reader/writer 208 may be omitted. On the other hand, when the external device 130 is the storage medium 240, the WLAN interface 207 (or other type of wireless communication circuit) may be omitted.

The relationship between FIGS. 2 and 3 is described below.

The vehicle information acquisition unit 111 is realized by the CAN interface 204 for fetching data from the CAN 103 and the CPU 201 for executing a program. In addition, since the CPU 201 operates according to a clock signal generated by a clock generator, the clock 112 is also realized by the CPU 201. The vehicle information management unit 113 is also realized by the CPU 201 which executes a program. The vehicle information storage unit 114 may also be realized by the non-volatile storage device 203, the RAM 202, and a combination of the RAM 202 and the non-volatile storage device 203.

The diagnosis unit 115 is also realized by the CPU 201 which executes a program.

The history management unit 116 may be realized by the WLAN interface 207 for communication with the server 230 through the network 220 and the CPU 201 which executes a program. Otherwise, the history management unit 116 may be realized by the reader/writer 208 which reads and writes data using the storage medium 240, and the CPU 201 which executes a program. In some cases, the history management unit 116 may be realized by the WLAN interface 207, the reader/writer 208, and the CPU 201.

The history storage unit 117 may be realized by the RAM 202, a combination of the RAM 202 and the non-volatile storage device 203, or the non-volatile storage device 203.

The judgment unit 118 is realized by the CPU 201 which executes a program. The advice determination unit 119 is also realized by the CPU 201 which executes a program.

The advice storage unit 120 is realized by the non-volatile storage device 203. The output control unit 121 may also be realized by a combination of the CPU 201 and the display interface 205, or may be realized by a combination of the CPU 201 and the speaker interface 206. In some cases, the output control unit 121 may be realized by a combination of the CPU 201, the display interface 205, and the speaker interface 206.

The program executed by the CPU 201 may be preinstalled in the non-volatile storage device 203, and may be downloaded from the network 220 and installed in the non-volatile storage device 203. Furthermore, a program may be stored in the storage medium 240 and provided, then read through the reader/writer 208, and installed in the non-volatile storage device 203.

The RAM 202, the non-volatile storage device 203, and the storage medium 240 are examples of computer-readable and tangible storage media. The RAM 202, the non-volatile storage device 203, and the storage medium 240 are not transitory media such as a signal carrier.

Various data used in the second embodiments are described below with reference to FIGS. 4 through 6. FIG. 4 illustrates examples of a driving record table and a vehicle table stored in the vehicle information storage unit 114.

A driving record table 301 in FIG. 4 is a table for holding time information indicating date and time, and the vehicle information 5 associated with the time information. Concretely, each entry of the driving record table 301 includes the fields of the date and time, the latitude, the longitude, the moved distance, the speed, the acceleration, and the yaw rate. Obviously, depending on the types of various sensors etc. equipped in the vehicle 100, one or more fields in the driving record table 301 may be omitted, and other fields may be added.

FIG. 4 exemplifies two entries of the driving record table 301. These two entries indicate the following.

At 12:10 on May 20, 2013, the vehicle information acquisition unit 111 acquired the vehicle information 5 through the CAN 103. In this case, it is detected that the vehicle 100 is positioned at latitude 35.580154° N, and longitude 139.642453° E. It is also detected that the speed of the vehicle 100 is 0 km/h, the acceleration of the vehicle 100 is 0.01 G, the yaw rate of the vehicle 100 is 0.0°/sec. However, at this time, the moved distance is not detected.

At 12:15:30 on May 20, 2013, the vehicle information acquisition unit 111 acquired the vehicle information 5 through the CAN 103. In this case, it is detected that the vehicle 100 is positioned at latitude 35.581925° N, and longitude 139.642566° E. Furthermore, it is also detected that the vehicle 100 has moved 0.5 m since the vehicle information acquisition unit 111 acquired the vehicle information 5. Furthermore, at this time, it is also detected that the speed of the vehicle 100 is 10 km/h, the acceleration of the vehicle 100 is −0.02 G, and the yaw rate of the vehicle 100 is 0.0°/sec.

A vehicle table 302 in FIG. 4 is an example of the vehicle information 5. To be more concrete, the vehicle table 302 is an example of vehicle specification information indicating the specification of the vehicle 100 currently being driven by the driver in the vehicle information 5. The vehicle table 302 includes the following field.

A vehicle identifier (in FIG. 4, the value is expressed as "ID")

A total width of the vehicle 100 (in FIG. 4, the value is expressed as "CW")

A vehicle weight of the vehicle 100 (in FIG. 4, the value is expressed as "Weight")

An engine output capability of the vehicle 100 (in FIG. 4, the value is expressed as "Pperform")

A steering wheel performance of the vehicle 100 (In FIG. 4, the value is expressed as "Hperform")

Obviously, in some embodiments, one or more fields in the vehicle table 302 may be omitted, and other fields may be added. The value of each field in the vehicle table 302 may be set in advance when the driving diagnosis device 110 is equipped into the vehicle 100. Otherwise, the value of each field in the vehicle table 302 may be, for example, acquired by the vehicle information acquisition unit 111 from any ECU through the CAN 103.

FIG. 5 illustrates examples of the vehicle table, the driving history table, and the statistical table stored in the history storage unit 117. In the second embodiment, the history information 7 is concretely expressed by the data of three types of tables. That is, the history information 7 includes the data of vehicle tables 303-1 through 303-P and the data of driving history tables 304-1 through 304-Q, and the data of statistical table 305 (1≤P≤Q).

Each vehicle table 303-*i* (1≤i≤P) is a table which stores various attribute values of each vehicle the driver has ever driven. Although there are various types of attributes of a vehicle each vehicle table 303-*i* includes the following field in the example in FIG. 5

A vehicle identifier for identification of a vehicle (in FIG. 5, the value is expressed as "ID")

A total width identified by a vehicle identifier (in FIG. 5, the value is expressed as "CW")

A vehicle weight identified by a vehicle identifier (in FIG. 5, the value is expressed as "Weight")

An engine output capability identified by a vehicle identifier (in FIG. 5, the value is expressed as "Pperform")

A steering wheel performance identified by a vehicle identifier (In FIG. 5, the value is expressed as "Hperform")

The engine output capability is concretely expressed by a power-to-weight ratio. The power-to-weight ratio may also be expressed by ps/kg. Otherwise, the engine output capability may be expressed by the maximum output. The maximum output may be expressed by, for example, horse power (ps). Furthermore, the steering wheel performance may also be expressed by the ratio of the turning angle of tires (the amount of change in yaw angle of the tires depending on the steering wheel operation of the driver) to the steering angle (that is, the angle at which the driver has turned the steering wheel).

The character "P" refers to the count value without double counting of the number of vehicles (including the vehicle 100 currently being driven by the driver) ever driven by the driver. Therefore, the expression 1≤P holds true. The character "Q" refers to the total number of vehicles driven by the driver (that is, when the driver drives the vehicle having a certain vehicle identifier plural times, the vehicle is counted the number of times it was driven. Therefore, the expression P≤Q holds true.

For example, assume that a driver uses a car sharing service (or a car rental service) in which a plurality of vehicles are leased to a plurality of drivers. Then, assume that the driving diagnosis device 110 in FIG. 2 is equipped in each vehicle to be leased. When the driver uses four times the following service, P=3, and Q=4.

When the service is used for the first time, the driver leases the vehicle having the vehicle identifier of 2.

When the service is used for the second time, the driver leases the vehicle having the vehicle identifier of 7.

When the service is used for the third time, the driver leases the vehicle having the vehicle identifier of 8.

When the service is used for the fourth time, the driver leases the vehicle having the vehicle identifier of 2.

Obviously, each embodiment is not only applicable when a driver uses a car sharing service (or a car rental service), but also applicable when the driver possesses a vehicle. For example, a driver may repeat buying his or her own car. Therefore, the experience of having driven a previously possessed vehicle may affect the driving of a newly purchased vehicle. Therefore, each embodiment is useful in presenting a more appropriate advice to a driver not only when a driver uses the car sharing service (or the car rental service) but also when the driver possesses a vehicle.

One of the vehicle tables 303-1 through 303-P is a table indicating the vehicle specification information about the vehicle 100. Therefore, it is equal to the vehicle table 302 in FIG. 4.

Each driving history table 304-*i* (1≤i Q) indicates the vehicle driven by the driver for the i-th time, the time information about the i-th driving, and the diagnosis result on the i-th driving. Concretely, in the example in FIG. 5, the driving history table 304-*i* includes the following field. For convenience of explanation below, vehicle driven by the driver for the i-th time is referred to as the "i-th vehicle".

A driving history number (expressed as "Num" in FIG. 5) for identification of the driving history table 304-*i*

A vehicle identifier for identification of the i-th vehicle (since the vehicle identifier is equal to the vehicle identifier of any of the vehicle tables 303-1 through 303-P, the value is expressed as "ID" in FIG. 5).

The driving time in which the driver has driven the i-th vehicle (the value is expressed as "TimePeriod" in FIG. 5).

A driving start date and time at which the driver started the driving of the i-th vehicle (the value is expressed as "StartTime" in FIG. 5).

A result of the diagnosis on the steering wheel operation when the driver was driving the i-th vehicle (the value is expressed as "DiagRes(1)" in FIG. 5

A result of the diagnosis on the running position when the driver was driving the i-th vehicle (the value is expressed as "DiagRes(2)" in FIG. 5

A result of the diagnosis on the sudden acceleration when the driver was driving the i-th vehicle (the value is expressed as "DiagRes(3)" in FIG. 5

The driving time may refer to the length of time from the time when the driver starts driving of the i-th vehicle to the time when the driver ends driving the i-th vehicle. Otherwise, when the driver intermittently drives the i-th vehicle, the longest period in some periods in which the driver is continuously driving the i-th vehicle may be stored in the driving history table 304-*i* as the driving time. The length of the longest period may be used as the driving time instead of the sum of the lengths of some periods described above or the average value.

For example, assume that the driver drives the i-th vehicle for 50 minutes, takes a rest for 10 minutes, and then drives the vehicle for 20 minutes. In this case, the definition of the driving time may be any of the following depending on the embodiments.

80 (=50+10+20) minutes. That is, the length of time from the start-of-driving time to the end-of-driving time 50 minutes. That is, the length of the longest period in the periods in which the driver continuously drove a vehicle.

70 (=50+20) minutes. That is, the sum of the lengths of two periods in which the driver continuously drove a vehicle.

35 (=(50+20)/2) minutes. That is, the average value of the two periods in which the driver continuously drove a vehicle.

In FIG. 5, the result of the diagnosis relating to three diagnosis items is included in the driving history table 304-*i*. However, there is a case that the history information (for example, the driving history table 304-*i*) does not include a result of a diagnosis. Furthermore, the problem of which diagnosis item is to be included in the driving history table 304-*i*, and which diagnosis item is not to be included in the driving history table 304-*i* may be appropriately determined depending on the embodiments.

While the driver is driving the i-th vehicle, two or more diagnoses may be conducted on a certain diagnosis item.

For example, assume that 25 diagnoses have been conducted on the steering wheel operation while the driver is driving the i-th vehicle. In this case, it is preferable that the driving history table 304-*i* stores a value representing 25 diagnosis results 6.

For example, the value that occurs the most frequently, the average value, or the median of the 25 diagnosis results 6 may be used. Otherwise, the average value of the 23 diagnosis results 6 excluding the highest and lowest diagnosis results 6 may be used. In some cases, 25 diagnosis results 6 may be represented by the highest or lowest diagnosis result 6.

As exemplified above, when plural diagnoses are conducted on a certain diagnosis item, a value representing a plurality of diagnosis results 6 are selected or calculated based on a specified policy according to an embodiment, and stored in the driving history table 304-*i*.

The statistical table 305 indicates the number of times the driver has transferred a vehicle to be driven. The number of times of the transfer indicated on the statistical table 305 is also expressed as "Cnt". In the second embodiment, the number of times of transfer Cnt is equal to (Q−1).

The number of times of transfer of the statistical table 305 is a type of history information 7 which is a simple summary of the driving history of a driver. On the other hand, each driving history table 304-*i* is an example of detailed history information 7 about the driving history of each vehicle ever driven by a driver. Each vehicle table 303-*i* is an example of vehicle specification information indicating the specification of a vehicle.

FIG. 6 is an example of an advice table stored in the advice storage unit 120. Concretely, FIG. 6 exemplifies an advice table 306-*j* relating to the j-th diagnosis item.

For example, assume that the diagnosis result 6 about the j-th diagnosis item is expressed by integers from 1 to 10. In FIG. 6, the diagnosis result 6 about the j-th diagnosis item is expressed as "Res(j)".

Furthermore, the influence degree 8 about the j-th diagnosis item (that is, the degree of influence from the driving experience on the diagnosis result 6 of the j-th diagnosis item) is expressed by real numbers in a certain range. In FIG. 6, the influence degree 8 about the j-th diagnosis item is expressed as "Inf(j)".

The advice table 306-*j* concretely includes 21 pieces of advice Adv(j, 1, 1) through Adv(j, 3, 7). Each piece of advice is associated with the combination of a diagnosis result Res (j) and an influence degree Inf(j). Obviously, the number of pieces of advice is optional depending on the embodiments.

As described above about the storage unit 3 in FIG. 1, the combination of the diagnosis result 6 and the influence degree 8 may be concretely expressed by a combination of a set of values indicating the diagnosis result 6 (for example, the range of a value), and a set of values indicating the influence degree 8 (for example, the range of a value)

In the example in FIG. 6, the following three ranges are used as the range of the value of the diagnosis result Res (j).

$1 \leq Res(j) \leq 3$ $4 \leq Res(j) \leq 7$ $8 \leq Res(j) \leq 10$

The number of ranges into which the value of the diagnosis result 6 is classified may be optionally determined depending on the diagnosis item. Furthermore, the value of the boundary between ranges may also be arbitrarily determined depending on the diagnosis item.

Furthermore, in the example in FIG. 6, the following seven ranges are used as the range of the value of the influence degree Inf (j).

$Inf(j) \leq -n(j)$ $-n(j) < Inf(j) \leq -m(j)$ $-m(j) < Inf(j) < 0$ $Inf(j) = 0$ $0 < Inf(j) < m(j)$ $m(j) \leq Inf(j) < n(j)$ $n(j) \leq Inf(j)$ The number of ranges into which the value of the diagnosis result 8 is classified may be optionally determined depending on the diagnosis item. Furthermore, the value of the boundary between ranges may also be arbitrarily determined depending on the diagnosis item. The values n(j) and m(j) illustrated in FIG. 6 are positive threshold specified relating to the j-th diagnosis, and satisfy $m(j) < n(j)$.

Depending on the equation used in calculating the influence degree Inf(j), there may be an upper limit, a lower limit, or both of them for the influence degree Inf(j), and there also may be no upper or lower limit for the influence degree Inf(j).

Furthermore, for each diagnosis item, the possible range of the value of the influence degree Inf(j) may be different for each diagnosis item. That is, there is a case that the normalization for equal possible range of the value of the influence degree Inf(j) of any diagnosis item is performed. Because a different advice table is provided for each diagnosis item. Depending on the possible range of the value, the threshold such as m(j), n(j), etc. is to be appropriately determined in the advice table 306-*j* for the j-th diagnosis item.

For example, when the range of the influence degree 8 about the j-th diagnosis item is not less than −1 and not more than 1, m(j) may be ⅓, and n(j) may be ⅔. Obviously, the values of the thresholds m(j) and n(j) may be the values other than ⅓ and ⅔. The values of the thresholds m(j) and n(j) may be arbitrarily determined.

In the example above, the symmetric thresholds −n(j) and n(j) are used, and also the symmetric thresholds −m(j) and m(j) are used. However, there is a case that symmetric positive and negative thresholds is not used.

In FIG. 6, seven ranges of the influence degree 8 are combined for any of the three ranges of the diagnosis result 6. However, in some embodiment, the definition of the combined range of the influence degree 8 (for example, the number of ranges, the value of the boundary between the ranges) may be different for each range of the diagnosis result 6.

For comprehensibility of the advice table 306-*j*, some more concrete examples are explained below.

For example, the case in which the j-th diagnosis item is an item about a steering angle is described below. For convenience of explanation below, assume that the smaller the value of the diagnosis result Res(j), the sharper the turn of the 100. For example, when $1 \leq Res(j) \leq 3$, the vehicle 100 is making a too sharp turn, when $4 \leq Res(j) \leq 7$, the vehicle 100 is making an appropriate turn, and when $8 \leq Res(j) \leq 10$, the vehicle 100 is making an insufficient turn.

Furthermore, the judgment unit 118 may calculate the influence degree Inf(j) so that the influence degree Inf(j) may be positive when the steering wheel performance of the vehicle 100 currently being driven by the driver is sharper than the steering wheel performance of another vehicle the driver has driven before. That is, the judgment unit 118 may calculate the influence degree Inf(j) so that the influence degree Inf(j) may be negative when the steering wheel performance of another vehicle the driver has driven before is sharper than the steering wheel performance of the vehicle 100 currently being driven by the driver.

In FIG. 6, the advice Adv(j,1,1) is associated with the diagnosis result Res(j) which satisfies $1 \leq Res(j) \leq 3$ and the influence degree Inf (j) which satisfies $Inf(j) \leq -n(j)$. The advice Adv(j,1,1) may be the following advice.

"You are turning your steering wheel too much at the start of the turn. Since the present vehicle is much slower in steering wheel operation than the vehicle you have driven before, you seem to be operating your steering wheel too much to compensate for the slowness. Please operate your steering wheel with earlier timing."

In addition, in FIG. 6, the advice Adv(j, 1, 4) is associated with the diagnosis result Res(j) which satisfies $1 \leq Res(j) \leq 3$ and the influence degree Inf (j) which satisfies Inf(j)=0. The advice Adv(j, 1, 4) may be the following advice.

"You are turning your steering wheel too much at the start of the turn. Please operate your steering wheel more gently."

Furthermore, in FIG. 6, the advice Adv(j, 1, 7) is associated with the diagnosis result Res(j) which satisfies 1≤Res (j)≤3 and the influence degree Inf (j) which satisfies n(j) ≤Inf(j). The advice Adv(j,1,7) may be the following advice.

"You are turning your steering wheel too much at the start of the turn. Since the present vehicle is much more sensitive in steering wheel operation than the vehicle you have driven before, the vehicle turns much more than you expect. Please operate your steering wheel more gently."

As clearly exemplified above, for example, when the value of the diagnosis result Res (j) is 2, uniform advice based on the diagnosis result of "2" is not presented, but the advice depending on the influence degree Inf(j) is presented. That is, appropriate advice with the consideration of the driving history of a driver is presented. Therefore, the driving diagnosis device 110 may appropriately support the driving of a driver.

As another example, explained is the case in which the j-th diagnosis item is an item about the running position of the vehicle 100. For convenience of explanation below, assume that the smaller the value of the diagnosis result Res(j) is, the closer to the left end of the lane the vehicle 100 runs. For example, when the expression 1≤Res (j)≤3 holds true, the vehicle 100 is closer to the left side of the lane. When the expression 4≤Res(j)≤7 holds true, the vehicle 100 is running appropriately around the center of the lane. When the expression 8≤Res(j)≤10 holds true, the vehicle 100 is closer to the right side of the lane.

The judgment unit 118 may calculate the influence degree Inf(j) so that the influence degree Inf(j) may be positive when the vehicle width of the vehicle 100 currently being driven by the driver is larger than the vehicle width of another vehicle the driver has driven before. That is, the judgment unit 118 may calculate the influence degree Inf(j) so that the influence degree Inf(j) may be negative when the vehicle width of another vehicle the driver has driven before is larger than the vehicle width of the vehicle 100 currently being driven by the driver.

For example, in the vehicle 100 into which the driving diagnosis device 110 is equipped, the driver's seat may be on the right, and the vehicle width of the vehicle 100 currently being driven by the driver may be smaller than the vehicle width of another vehicle the driver has driven before. In this case, the influence degree Inf(j) is negative. Furthermore, there is the possibility that the driver tries to maintain the position of the driver on the line in the position of his or her vehicle driven in the past. As a result, there is the possibility that the vehicle 100 is closer to the right side of the lane.

When the vehicle 100 is closer to the right side of the lane, the diagnosis result Res (j) satisfies the expression 8≤ Res(j)≤10. For example, as illustrated in FIG. 6, the advice Adv(j,3,1) is associated with the diagnosis result Res(j) which satisfies the expression 8≤Res(j)≤10 and the influence degree Inf (j) which satisfies the expression Inf(j)≤−n(j). Therefore, the advice Adv(j,3,1) may be the following advice: "While you are driving your vehicle forward, you are driving it closer to the right side. Since the width of the present vehicle is much smaller than that of the vehicle you drove before, please be careful to keep larger space between the right side line of the lane and your vehicle than before."

On the other hand, when the driver seat is positioned on the right in the vehicle 100 and the width of the vehicle 100 is smaller than another vehicle the driver has driven before, there is the possibility that the vehicle 100 is closer to the left side of the lane unlike the example above. For example, when the driver tries to maintain the distance of the prior driving, there is the possibility that the vehicle 100 is closer to the left side of the lane.

When the vehicle 100 is closer to the left side of the lane, the diagnosis result Res (j) satisfies the expression 1≤Res (j)≤3. For example, as illustrated in FIG. 6, the advice Adv(j, 1, 1) is associated with the diagnosis result Res(j) which satisfies the expression 1≤Res(j)≤3 and the influence degree Inf (j) which satisfies the expression Inf(j)≤−n(j). Therefore, the advice Adv(j, 1, 1) may be the following advice: "While you are driving your vehicle forward, you are driving it closer to the left side. Since the width of the present vehicle is much smaller than that of the vehicle you drove before, please be careful to keep larger space between the left side line of the lane and your vehicle than before to carefully drive your vehicle around the center of the lane."

The contents of the advice table 306-*j* may depend on the specification of the vehicle 100 (for example, whether the driver seat is placed on the right or left).

As another example, the case in which the j-th diagnosis item is an item about the operation of an accelerator is explained below. For convenience of explanation below, assume that the smaller the value of the diagnosis result Res(j) is, the acceleration is sharp. For example, when the expression 1≤Res (j)≤3 holds true, the acceleration is too sharp. When the expression 4≤Res(j)≤7 holds true, the acceleration is appropriate. When the expression 8≤Res(j)≤10 holds true, the acceleration is too slow.

The judgment unit 118 may calculate the influence degree Inf(j) so that the influence degree Inf(j) may be positive when the acceleration performance of the vehicle 100 currently being driven by the driver is higher than the acceleration performance of the another vehicle the driver has driven before. That is, the judgment unit 118 may calculate the influence degree Inf(j) so that the influence degree Inf(j) may be negative when the acceleration performance of the another vehicle the driver has driven before is higher than the acceleration performance of the vehicle 100 currently being driven by the driver.

For example, as illustrated in FIG. 6, the advice Adv(j,1,1) is associated with the diagnosis result Res(j) which satisfies the expression 1≤Res (j)≤3 and the influence degree Inf(j) which satisfies the expression Inf(j)≤−n(j). Therefore, the advice Adv(j,1,1) may be the following advice: "You are accelerating your vehicle too suddenly. Since the present vehicle is inferior in acceleration performance to the vehicle you have driven before, your pedaling force seems to be too strong to compensate for the low acceleration performance of the present vehicle. Although it may take a long time for you to well understand the features of the present vehicle, your current driving will incur poor mileage. Please drive your vehicle with smooth acceleration."

In addition, as illustrated in FIG. 6, the advice Adv(j,1,7) is associated with the diagnosis result Res(j) which satisfies the expression 1≤Res (j)≤3 and the influence degree Inf j) which satisfies the expression n(j)≤Inf(j). Therefore, the advice Adv (j, 1, 7) may be the following advice: "You are accelerating your vehicle too suddenly. The present vehicle is superior in acceleration performance to the vehicle you have driven before. Since your pedaling force seems to be the same as with your previous vehicle, your pedaling force incurs the sudden acceleration. Although it may take a long time for you to well understand the features of the present vehicle, your current driving will incur poor mileage. Please drive your vehicle with gentle acceleration."

Figure 7:
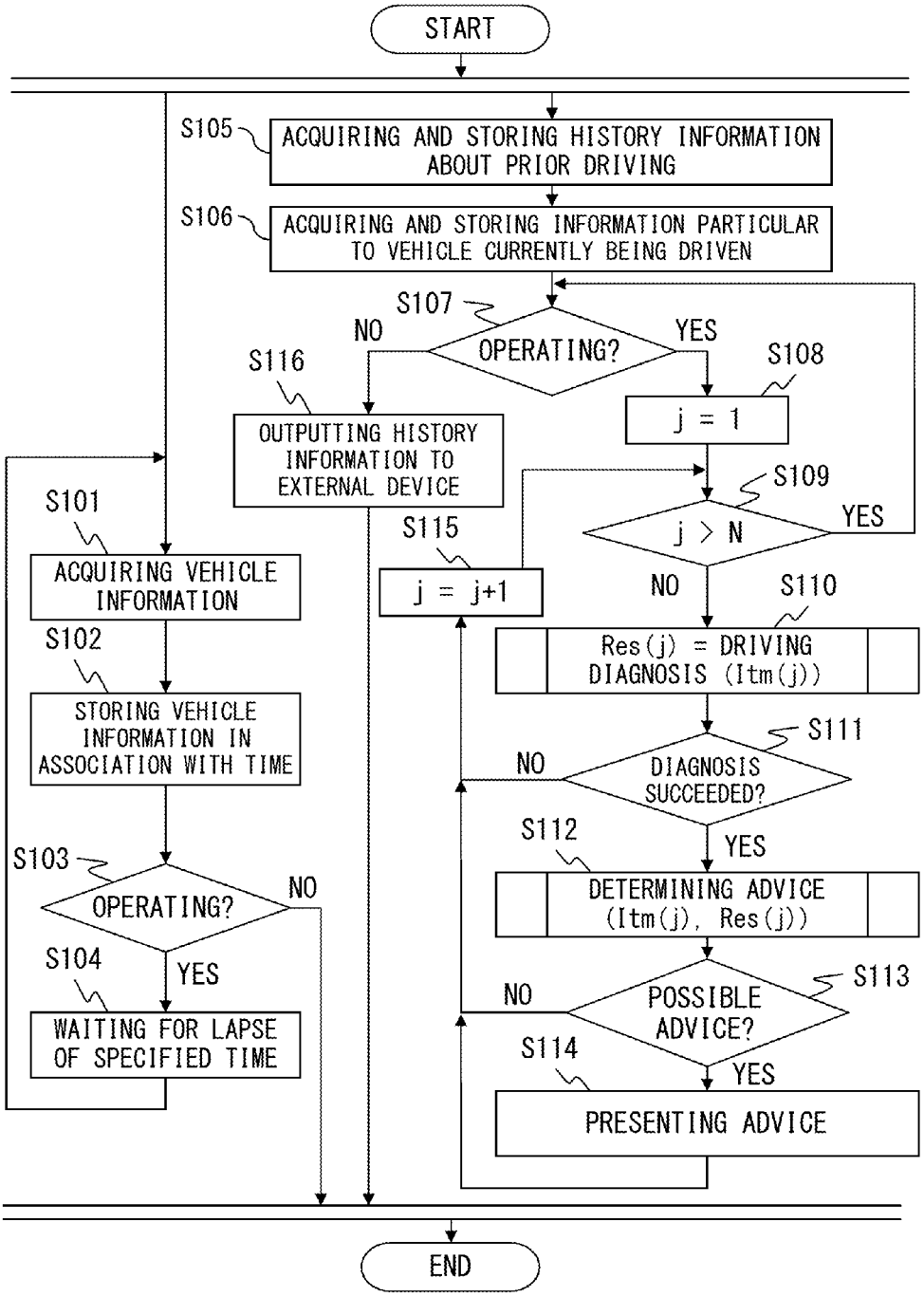
FIG. 7 is a flowchart of the process performed by the driving diagnosis device.

The process performed according to the second embodiment is described below with reference to FIGS. 7 through 9. FIG. 7 is a flowchart of the process performed by the driving diagnosis device 110.

When the vehicle 100 is activated, the driving diagnosis device 110 starts the process in FIG. 7. Concretely, when the driver inserts the ignition key in the keyhole and turns the key to the specified position, the driving diagnosis device 110 switches on and is activated. Then, the driving diagnosis device 110 starts the process illustrated in FIG. 7.

The process in FIG. 7 includes the following four types of processes. The first process in steps S101 through S104 is repeatedly performed to acquire and store the vehicle information 5 while the driving diagnosis device 110 is operating. The second through fourth processes are performed concurrently with the first process. The second process is the initializing process in steps S105 and S106. The third process in steps S107 through S115 is repeatedly performed to present a diagnosis and advice while the driving diagnosis device 110 is operating. The fourth process in step S116 is the postprocessing performed when the driving diagnosis device 110 switches off. Described concretely below are the processes in steps S101 through S116.

When the driving diagnosis device 110 is activated, the vehicle information acquisition unit 111 acquires various types of vehicle information 5 (for example, the latitude, the longitude, the moved distance, the speed, the acceleration, the yaw rate, etc.). As described above, the vehicle information acquisition unit 111 may acquire the vehicle information 5 through the CAN 103, and acquire the vehicle information 5 from the sensor or ECU connected to the vehicle information acquisition unit 111 through a signal line. The vehicle information acquisition unit 111 outputs the acquired vehicle information 5 to the vehicle information management unit 113.

Then, in step S102, the vehicle information management unit 113 stores the vehicle information 5 in association with the time in the vehicle information storage unit 114. Concretely, the vehicle information management unit 113 refers to the clock 112 and read the current time. Then, the vehicle information management unit 113 adds an entry which associates the current time with the vehicle information 5 obtained from the vehicle information acquisition unit 111 to the driving record table 301.

Next, in step S103, the vehicle information acquisition unit 111 judges whether or not the driving diagnosis device 110 is operating. For example, if an interrupt signal for switch off of the driving diagnosis device 110 is detected, the vehicle information acquisition unit 111 judges that the driving diagnosis device 110 is not operating. On the other hand, unless an interrupt signal is detected, the vehicle information acquisition unit 111 judges that the driving diagnosis device 110 is operating.

If it is judged that the driving diagnosis device 110 is not operating, the first process above (that is, the process in steps S101 through S104) terminates. On the other hand, if the driving diagnosis device 110 is operating, the vehicle information acquisition unit 111 waits for the lapse of specified time in step S104. The specified time in step S104 is an interval at which the vehicle information acquisition unit 111 acquires the vehicle information 5. The specified time may be appropriately determined according to an embodiment. If a specified time has passed, the vehicle information acquisition unit 111 performs the process in step S101 again.

On the other hand, as described above, the process in steps S105 through S116 is performed concurrently with steps S101 through S104. Concretely, when the driving diagnosis device 110 is activated, the history management unit 116 acquires the history information 7 relating to the prior driving from the external device 130, and stores the acquired history information 7 in the history storage unit 117.

For example, when the external device 130 is the storage medium 240, the history management unit 116 reads the following data from the storage medium 240, and stores the read data in the history storage unit 117.

Data of the vehicle table about each vehicle the driver has ever driven

Data of the driving history table relating to the driving history of the driver

The history management unit 116 counts the number of driving history tables stored in the storage medium 240, and writes the counted value as the number of times of transfer Cnt to the statistical table 305.

If the driver has not driven any other vehicles nor the vehicle 100 itself in the past, the storage medium 240 stores no vehicle table or driving history table. In this case, the history management unit 116 writes the value of 0 as the number of times of transfer Cnt to the statistical table 305.

Otherwise, the external device 130 may be the server 230. In this case, the history management unit 116 accesses the server 230 through the network 220. At this time, the history management unit 116 notifies the server 230 of the identifier for identification of the driver who is going to drive the vehicle 100 (hereafter referred to as a "driver ID".

For example, the driver may carry the card key or a storage medium which stores the driver ID. The storage medium which stores the driver ID may be the storage medium 240 used as the external device 130, and other storage media. When the driving diagnosis device 110 is activated, the history storage unit 117 reads the driver ID from the card key or the storage medium, and notifies the server 230 of the driver ID.

The server 230 may store the history information 7 (concretely a driving history table) about a plurality of drivers. Furthermore, assume that the server 230 stores the vehicle table about each of a plurality of vehicles.

The server 230 searches the driving history table associated with the driver ID which has been notified from the history management unit 116.

Unless the driver has driven any vehicle whose vehicle table is registered in the server 230, there is no driving history table of the driver. In this case, the server 230 notifies the history management unit 116 that there is no driving history table. Then, the history management unit 116 writes the value of 0 as the number of times of transfer Cnt to the statistical table 305.

On the other hand, if the driver has driven at least one of the vehicles whose vehicle tables are registered in the server 230, then one or more driving history tables associated with the notified driver ID are detected as a result of the search. In this case, the server 230 searches the vehicle table identified by the vehicle identifier of each detected driving history table. As a result of the search, one or more vehicle tables are detected. The server 230 transmits to the history management unit 116 the data of each detected driving history table and the data of each detected vehicle table through the network 220.

Then, the history management unit 116 stores each driving history table and vehicle table whose data has been received from the server 230 in the history management unit 116. The history management unit 116 also counts the number of driving history tables whose data has been received from the server 230, and writes the counted value as the number of times of transfer Cnt to the statistical table 305.

As described above, regardless of whether the external device 130 is the storage medium 240 or the server 230, the history information 7 relating to the driving history is stored in the history management unit 116 in step S105.

The driving history of the driver may be the following first through fourth cases. The result of the process in step S105 in each case is described below.

In the first case, the driver has not driven any of the vehicles into which the driving diagnosis device 110 is equipped. The first case corresponds to the case where P=W=1 in FIG. 5 (assume that FIG. 5 illustrates the state of the history storage unit 117 after the process performed in step S106 as described later).

In the first case, no vehicle table is stored in step S105. In the first case, no driving history table has been stored in step S105. Therefore, in the first case, the statistical table 305 stores the value of 0 as the number of times of transfer Cnt.

In the second case, the driver has driven D1 times the vehicle 100, but has not driven other vehicles into which the driving diagnosis device 110 is equipped (D1≥1). The second case corresponds to the case in which P=1 and Q=D1+1 in FIG. 5.

In the second case, in step S105, the vehicle table 303-1 indicating the specification of the vehicle 100 is stored. In the second case, in step S105, the driving history tables 304-1 through 304-(Q−1) about the history of the driver driving the vehicle 100 are stored. Therefore, in the second case, the statistical table 305 stores the value of (Q−1) as the number of times of transfer Cnt.

The third case corresponds to that the driver has not driven the vehicle 100 itself, but has driven D2 times one or more other vehicles into which the driving diagnosis device 110 is equipped (D2≥1). The third case corresponds to the case where the expressions P>1 and Q=D2+1 hold true in FIG. 5.

In the third case, in step S105, the vehicle tables 303-1 through 303-(P−1) about (P−1) vehicles the driver has driven before are stored. In the third case, the vehicle table 303-P about the vehicle 100 is stored in step S106. In the third case, in step S105, the driving history tables 304-1 through 304-(Q−1) about the history of the driver driving (Q−1) times other (P−1) vehicles are stored. Therefore, in the third case, the statistical table 305 stores the value of (Q−1) as the number of times of transfer Cnt.

The fourth case is that the driver has driven D1 times the vehicle 100 itself, and have driven D2 times other one or more vehicles into which the driving diagnosis device 110 is equipped (D1≥1 and D2≥1). The fourth case corresponds to the case where the expressions P>1 and Q=D1+D2+1 hold true in FIG. 5.

In the fourth case, in step S105, the vehicle tables 303-1 through 303-P about P vehicles the driver has driven before are stored. In the fourth case, one of the vehicle tables 303-1 through 303-P indicates the specification of the vehicle 100. In the fourth case, in step S105, the driving history tables 304-1 through 304-(Q−1) about the driving history of the driver are stored. Therefore, in the fourth case, the statistical table 305 stores the value of (Q−1) as the number of times of transfer Cnt.

In step S106 after step S105 described above, the history management unit 116 acquires the information particular to the vehicle 100 currently being driven by the driver the driver (that is, the vehicle specification information about the vehicle 100). Concretely, the history management unit 116 requests the vehicle information management unit 113 to transfer the data of the vehicle table 302. The vehicle information management unit 113 reads the data of the vehicle table 302 from the vehicle information storage unit 114, and outputs the data to the history management unit 116.

In the second embodiment, it is assumed that the 302 is stored in the vehicle information storage unit 114 in advance. For example, when the driving diagnosis device 110 is equipped into the vehicle 100, the value of each field of the vehicle table 302 may be set. Therefore, the vehicle information management unit 113 may read the data of the vehicle table 302 at the request from the history management unit 116 in step S106.

Depending on the embodiment, when the process in step S101 is performed for the first time, the vehicle information acquisition unit 111 may acquire the vehicle information 5 corresponding to each field of the vehicle table 302 through the CAN 103. When the process in step S102 is performed for the first time, there is a case that the vehicle information management unit 113 adds an entry to the driving record table 301 according to the vehicle information 5 output from the vehicle information acquisition unit 111 and there is also another case that the vehicle information management unit 113 sets a value in each field of the vehicle table 302.

In any case, in step S106, the history management unit 116 acquires the data of the vehicle table 302 through the vehicle information management unit 113.

The history management unit 116 judges whether or not there is a vehicle table having a vehicle identifier equal to the vehicle identifier included in the data acquired through the vehicle information management unit 113.

In the above-mentioned first or third case, in the history storage unit 117, there is no vehicle table having the vehicle identifier equal to the vehicle identifier included in the data acquired through the vehicle information management unit 113. Therefore, the history management unit 116 stores the data acquired through the vehicle information management unit 113 as the vehicle table 303-P in the history storage unit 117. In the first and third cases, the expressions P=1 and P>1 hold true respectively.

On the other hand, in the second or fourth case above, the vehicle table having the vehicle identifier equal to the vehicle identifier included in the data acquired through the vehicle information management unit 113 exists in the history storage unit 117. Therefore, there is a case that the history management unit 116 does not add a vehicle table to the history storage unit 117.

Furthermore, in step S106, the history management unit 116 adds the driving history table 304-Q about the current driving to the history storage unit 117, and initializes the driving history table 304-Q.

For example, an integer i may be used as a driving history number of the driving history table 304-*i*. In this case, the history management unit 116 sets the value of Q in the field of the driving history number of the driving history table 304-Q.

Furthermore, the history management unit 116 sets the vehicle identifier of the vehicle 100 (that is, the vehicle identifier included in the data the history management unit 116 acquired through the vehicle information management unit 113) in the field of the vehicle identifier of the driving history table 304-Q. The field of the driving time and the field of the diagnosis result are initialized to an invalid value or null.

The current time is set in the field of the driving start date and time. For example, the vehicle information management unit 113 may read the current time from the clock 112 when the data of the vehicle table 302 is output to the history management unit 116 as described above, and notify the history management unit 116 of the current time. Otherwise, the history management unit 116 may directly read the current time from the clock 112. Anyway, the field of the driving start date and time is initialized to the value of the current time.

Depending on the embodiments, the process in step S106 may be performed before the process in step S105. When the processes in steps S105 and S106 are completely initialized, the process in step S107 is next performed.

Concretely, in step S107, the diagnosis unit 115 judges whether or not the driving diagnosis device 110 is operating. The diagnosis unit 115 may make a judgment in step S107 according to an interrupt signal as it makes a judgment by the vehicle information acquisition unit 111 in step S103.

Upon judgment that the driving diagnosis device 110 is not operating, the diagnosis unit 115 requests the history management unit 116 to perform the postprocessing in step S116.

On the other hand, when it is judged that the driving diagnosis device 110 is operating, the diagnosis unit 115 initializes the index variable j to 1 in step S108. Then, the diagnosis unit 115 judges whether or not the expression j>N holds true in step S109 where N indicates the number of diagnosis items (N≥1).

When the expression j>N holds true, the diagnosis unit 115 makes a judgment again in step S107. On the other hand, when the expression j≤N holds true, the diagnosis unit 115 performs the driving diagnosing process on the j-th diagnosis item in step S110. For convenience of explanation below, it is assumed that the diagnosis item ID of the j-th diagnosis item is expressed as "Itd (j)", and the result of the diagnosis conducted by the diagnosis unit 115 on the j-th diagnosis item is expressed as "Res(j)". The details of the driving diagnosing process in step S110 is described later with reference to FIG. 8.

Next, in step S111, the diagnosis unit 115 judges whether or not the driving diagnosing process in step S110 has been successfully performed. As described later with reference to FIG. 8 in detail, there is the possibility that the diagnosis result 6 is not acquired depending on the timing with which the driving diagnosing process is performed, the behavior of the vehicle 100, and the combination of the diagnosis item. The diagnosis unit 115 judges that the driving diagnosing process has been successfully performed when the diagnosis result 6 is acquired, and judges that the driving diagnosing process has failed when the diagnosis result 6 is not acquired.

When the driving diagnosing process is successfully performed, the diagnosis unit 115 notifies the advice determination unit 119 of the diagnosis item ID (Itm(j)) of the j-th diagnosis item and the obtained diagnosis result Res(j). Then, the advice determination unit 119 starts the advice determining process in step S112. The details of the advice determining process are described later with reference to FIG. 9.

On the other hand, when the driving diagnosing process fails, the diagnosis unit 115 performs the process in step S115 after step S111.

In the advice determining process in step S112, the advice determination unit 119 determines to present certain advice to a driver, and outputs the certain advice to the output control unit 121.

Upon receipt of the advice from the advice determination unit 119, the output control unit 121 judges in step S113 whether or not it is possible to present the advice to the driver. As explained above with reference to FIG. 2, the output control unit 121 acquires the vehicle information 5 through the vehicle information management unit 113, and estimates the state of the vehicle 100 according to the vehicle information 5. The output control unit 121 judges whether or not it is possible to present the advice to the driver based on the estimated state. For example, when the vehicle 100 is stopped or running forward at a low speed, the output control unit 121 may judge that it is possible to present the advice to the driver.

When the output control unit 121 judges that it is possible to present the advice to the driver, it controls in the next step S114 to present the advice to the driver. The details of the control are explained above with reference to FIG. 2. According to the control of the output control unit 121, the display 104 and/or the speaker 105 outputs advice in step S114. Then, control is passed to step S115.

On the other hand, when the output control unit 121 judges in step S113 that it is not possible now to present the advice to the driver, the process in step S114 is omitted, and control is passed to step S115.

In step S115, the diagnosis unit 115 increments the index variable j by 1. Then, the diagnosis unit 115 makes a judgment again in step S109. As described above, the driving diagnosing process and the subsequent processes are repeatedly performed on each of N diagnosis items while the driving diagnosis device 110 is operating.

On the other hand, when it is judged in step S107 that the driving diagnosis device 110 is not operating, the postprocessing in step S116 is performed. Concretely, in step S116, the history management unit 116 outputs at least a part of the history information 7 in the history storage unit 117 to the external device 130. Relating to each of the first through fourth cases explained above with reference to step S105, a concrete example of the history information 7 output in step S116 is explained below.

In the first or third case, the history management unit 116 outputs the vehicle table 303-P about the vehicle 100 to the external device 130. In the second or fourth case, the external device 130 has already stored the vehicle table about the vehicle 100. Therefore, in the second or fourth case, there is a case that the history management unit 116 does not output the vehicle table 303-P to the external device 130.

Furthermore, in any of the first through fourth cases, the history management unit 116 outputs the driving history table 304-Q relating to the driving of the vehicle 100 to the external device 130. Some fields in the driving history table 304-Q may be updated after initialized in step S106 as described above in, for example, step S110. Otherwise, before outputting the driving history table 304-Q, the history management unit 116 may update some fields in the driving history table 304-Q in step S116. The update of the fields in the driving history table 304-Q is described later with reference to step S206 in FIG. 8.

When the output of the history information 7 to the external device 130 is completed in step S116, the driving diagnosis device 110 terminates the process illustrated in FIG. 7.

Figure 8:
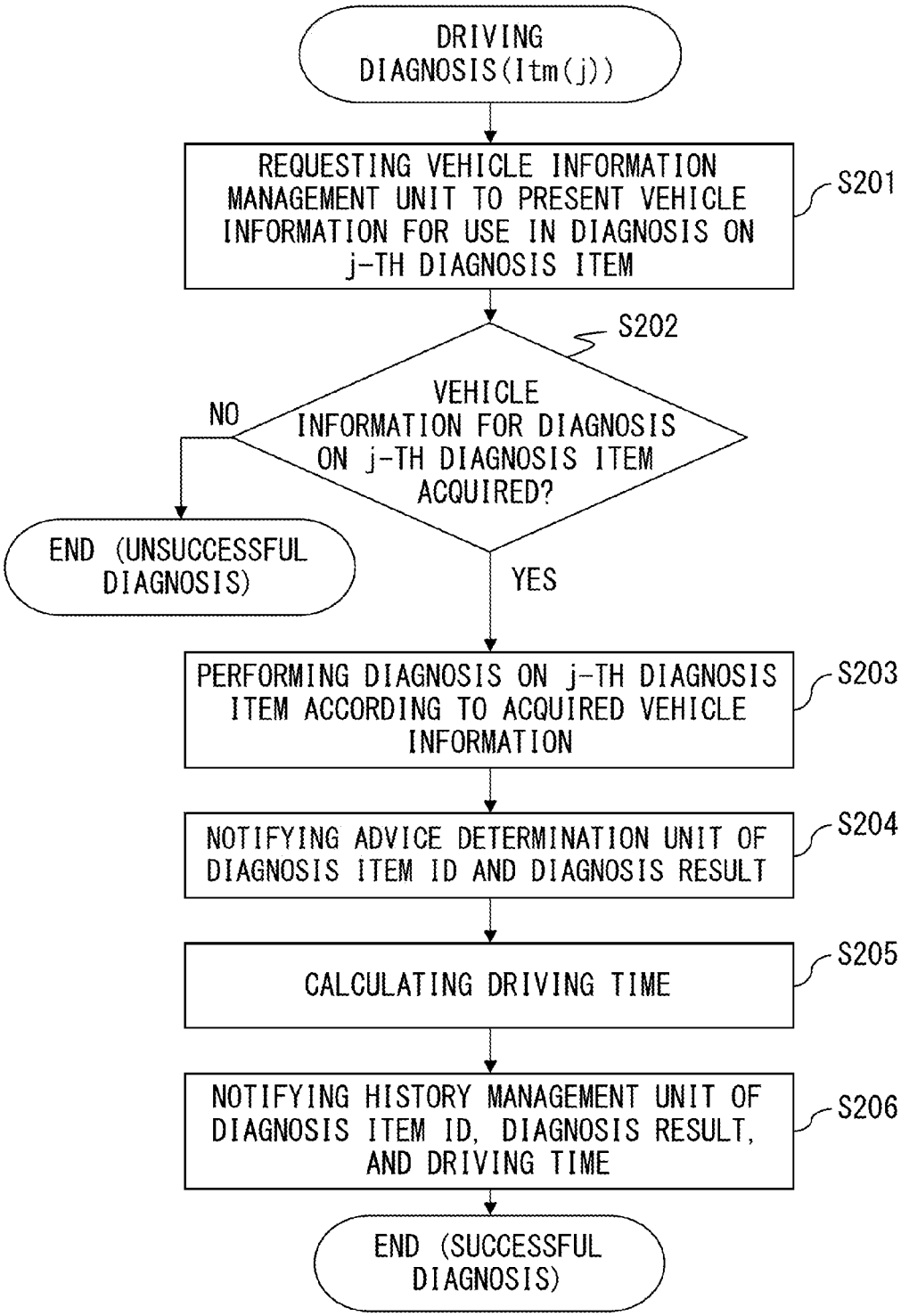
FIG. 8 is a flowchart of a driving diagnosing process.

FIG. 8 is a flowchart of the driving diagnosing process in step S110 in FIG. 7. The diagnosis unit 115 conducts a diagnosis according to the algorithm depending on diagnosis items with the appropriate vehicle information 5 depending on diagnosis items. The flowchart in FIG. 8 illustrates the case in which the diagnosis unit 115 performs the driving diagnosing process on the j-th diagnosis item having the diagnosis item ID of Itm(j).

In step S201, the diagnosis unit 115 requests the vehicle information management unit 113 to present the vehicle information 5 for use in the diagnosis on the j-th diagnosis item.

For example, when the diagnosis on the j-th diagnosis item is based on the yaw rate and the steering angle in the latest 10 seconds, the diagnosis unit 115 requests the vehicle information management unit 113 to present the data of the yaw rate and the steering angle in the latest 10 seconds in the vehicle information 5. Then, the vehicle information management unit 113 extracts the data of each field of the data and time, the yaw rate, and the steering angle from each entry included in the period of the latest 10 seconds in the entries of the driving record table 301, and returns the extracted data to the diagnosis unit 115.

The number of types and which types of vehicle information 5 are to be used depend on the diagnosis items. Therefore, the vehicle information management unit 113 extracts from the driving record table 301 the data of the fields specified by the diagnosis unit 115 and the date and time field.

Furthermore, when the vehicle information 5 to be used in the diagnosis was acquired depends on diagnosis items. For example, only the data in the latest entry of the driving record table 301 may be used in the diagnosis on a certain diagnosis item. On the other hand, in the diagnosis on another diagnosis item, the data of some entries included in a certain length of period may be used.

Upon receipt of the data from the vehicle information management unit 113, the diagnosis unit 115 next makes a judgment in step S202. Concretely, the diagnosis unit 115 judges whether or not the vehicle information 5 for diagnosis on the j-th diagnosis item has been obtained. In more detail, the diagnosis unit 115 judges whether or not the vehicle information 5 which satisfies the precondition of conducting the diagnosis on the j-th diagnosis item has been acquired.

For example, assume that the j-th diagnosis item is diagnosed relating to the running position on the lane of the vehicle 100 in the case in which it is assumed that the vehicle 100 is running substantially forward. Furthermore, assume that the diagnosis on the running position is conducted based on the data of the latest 5 seconds (concretely the data including camera images).

In this case, the diagnosis unit 115 may request the vehicle information management unit 113 to present the data of, for example, the camera image and the yaw rate in the latest 5 seconds. Then, the diagnosis unit 115 may judge in step S202 whether or not it is assumed that the vehicle 100 is running forward in the latest 5 seconds from the data of the yaw rate returned from the vehicle information management unit 113.

When it is not assumed that the vehicle 100 is running forward, the diagnosis unit 115 may judge that the vehicle information 5 which satisfies the precondition for diagnosis on the j-th diagnosis item (that is, the camera image shot when the vehicle 100 was running forward) has not been acquired.

Depending on the interval at which an onboard camera shoots an image, there is the possibility that the onboard camera has not shot an image in the latest 5 seconds. Even when there is no camera image shot in the latest 5 seconds, the diagnosis unit 115 may judge that the vehicle information 5 which satisfies the precondition for diagnosis on the j-th diagnosis item has not been acquired.

Obviously, the explanation above is only an exemplification. In step S202, the diagnosis unit 115 conducts a diagnosis in an appropriate method depending on the diagnosis items. When the diagnosis unit 115 judges that the vehicle information 5 which satisfies the precondition for diagnosis on the j-th diagnosis item has not been acquired, the diagnosis unit 115 judges it as a wrong diagnosis, thereby terminating the driving diagnosing process in FIG. 8.

On the other hand, when the diagnosis unit 115 judges that the vehicle information 5 which satisfies the precondition for diagnosis on the j-th diagnosis item has been acquired, the diagnosis unit 115 performs the process in step S203. Concretely, the diagnosis unit 115 performs the diagnosis on the j-th diagnosis item according to the vehicle information 5 acquired in step S201.

Then, in step S204, the diagnosis unit 115 notifies the advice determination unit 119 of the diagnosis item DI (that is, Itm(j)) and the diagnosis result 6 (Res (j)) acquired in step S203.

Furthermore, in step S205, the diagnosis unit 115 calculates the driving time. The diagnosis unit 115 may calculate the driving time, for example, as described below.

When the diagnosis unit 115 first performs the process in FIG. 8, the diagnosis unit 115 may inquire of the history management unit 116 about the driving start date and time. At the inquiry, the history management unit 116 reads the driving start date and time from the driving history table 304-Q about the current driving of the vehicle 100, and notifies the diagnosis unit 115 of the driving start date and time. The diagnosis unit 115 locally stores the notified driving start date and time on the RAM 202.

Otherwise, when the process in FIG. 8 is first performed, the diagnosis unit 115 may request the vehicle information management unit 113 to transfer not only the vehicle information 5 for diagnosis but also the time information indicating the time at which the vehicle information 5 has first acquired after the activation of the driving diagnosis device 110 in step S201. Then, the diagnosis unit 115 may store the time information received from the vehicle information management unit 113 locally on the RAM 202. It may be assumed that the time indicated by the time information is substantially equal to the driving start date and time.

As described above, each time the diagnosis unit 115 performs the driving diagnosing process in FIG. 8, it receives the vehicle information 5 with the time information from the vehicle information management unit 113 in step S201. Concretely, the diagnosis unit 115 receives the data of one or more entries of the driving record table 301 from the vehicle information management unit 113. That is, the diagnosis unit 115 receives one or more pieces of the time information indicating date and time in step S201. In step S205, the diagnosis unit 115 may calculate the driving time by subtracting the locally stored driving start date and time from the latest date and time in the above-mentioned one or more pieces of date and time data indicated by the received time information.

As explained above with reference to FIG. 5, there may be various definitions of the driving time. The method of calculating the driving time is an example of a calculating method in which it is defined that the driving time is the period from the start-of-driving time to the end-of-driving time. Depending on the definition of the driving time, the diagnosis unit 115 acquire appropriate time information from the vehicle information management unit 113, appropriately stores the time information locally, and uses the information, thereby calculating the driving time.

The execution order of the processes in steps S204 and S205 may be inverted.

Finally, in step S206, the diagnosis unit 115 notifies the history management unit 116 of the diagnosis item ID (that is, Itm(j)), the diagnosis result 6 acquired in step S203 (that is, Res(j)), and the driving time calculated in step S205. Then, the diagnosis unit 115 terminates the driving diagnosing process in FIG. 8. In this case, the diagnosis unit 115 judges a successful diagnosis.

Upon receipt of the notification of the diagnosis item ID, the diagnosis result 6, and the driving time in step S206, the history management unit 116 appropriately updates the driving history table 304-Q relating to the driving of the vehicle 100. Concretely, the history management unit 116 overwrites the driving time field of the driving history table 304-Q with the notified value of the driving time.

As explained with reference to FIG. 5, the diagnosis result 6 stored as a diagnosis result in the driving history table 304-Q is a type of statistic which represents the result of each of a plurality of diagnoses.

For example, when a maximum value is used as a statistic, the history management unit 116 compares the value currently stored in the driving history table 304-Q with the value notified from the diagnosis unit 115 in step S206. If the notified value is larger than the value currently stored in the driving history table 304-Q, the history management unit 116 may overwrite the value stored in the driving history table 304-Q with the notified value. Even when the minimum value is used as a statistic, the history management unit 116 appropriately updates the driving history table 304-Q based on the comparison between the value stored in the driving history table 304-Q and the value notified from the diagnosis unit 115 in a similar method.

Otherwise, the history management unit 116 may locally hold the data for use in the calculation of a statistic in the RAM 202. Each time the diagnosis result 6 is notified in step S206, the history management unit 116 may update local data.

For example, when the mode value is used as a statistic, the history management unit 116 locally holds the count value for count of the number of times the value is obtained for each value of the diagnosis result 6. Each time the diagnosis result 6 is notified from the diagnosis unit 115 in step S206, the history management unit 116 may increment the count value corresponding to the notified value.

In this case, the history management unit 116 may obtain the mode value of the diagnosis result based on the counter value, and write the mode value in the driving history table 304-Q. After the update of the driving history table 304-Q, the history management unit 116 may perform the output processing in step S116.

Not only the mode value, but also the statistic of other types such as an average value etc. is used, the history management unit 116 may calculate the value stored as a diagnosis result in the driving history table 304-Q by using the appropriate local data.

Figure 9:
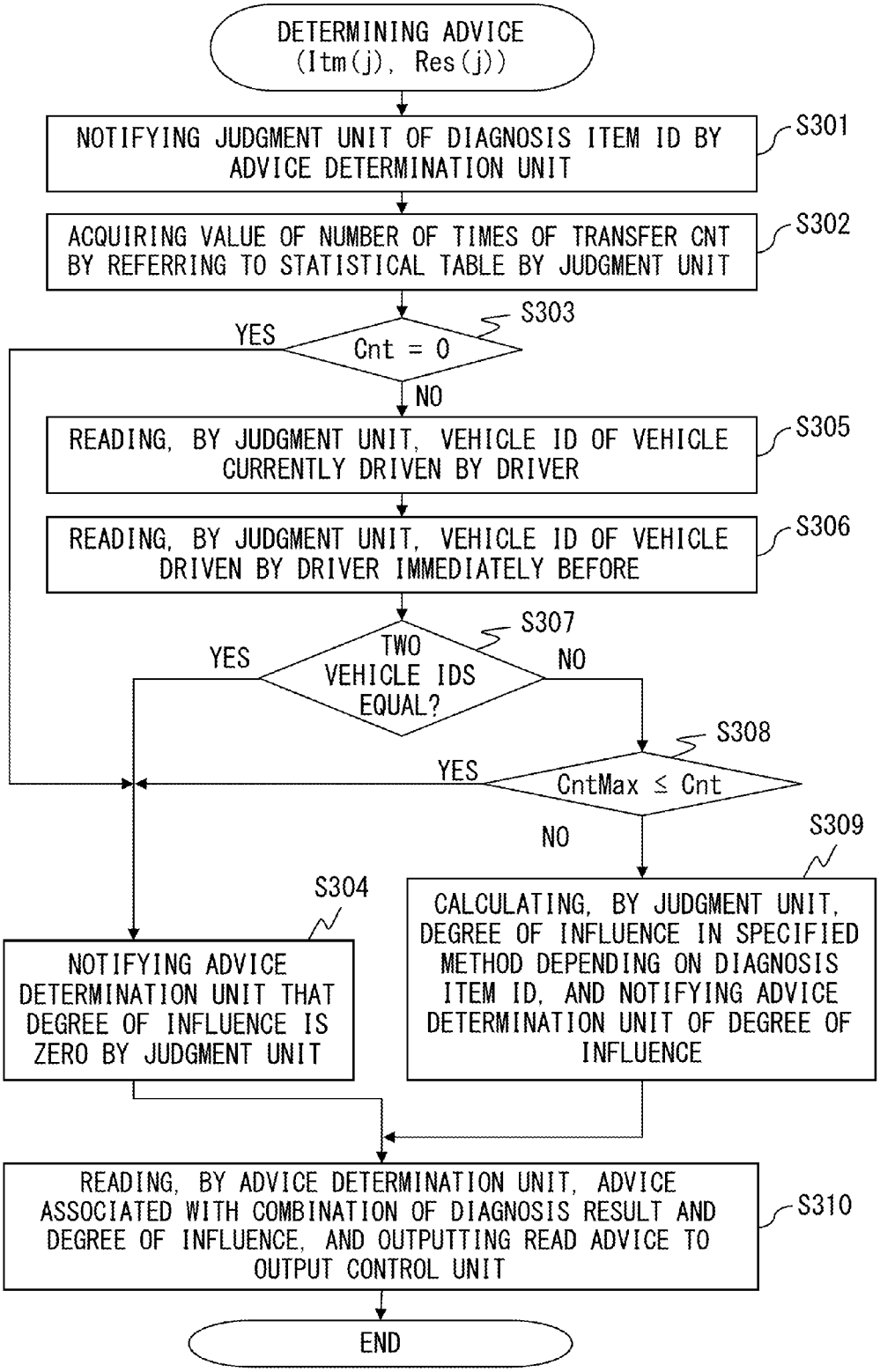
FIG. 9 is a flowchart of an advice determining process according to the second embodiment.

FIG. 9 is a flowchart of the advice determining process in step S112 in FIG. 7. As described later in detail, the details of the advice determining process may be varied depending on the embodiments.

The process in step S112 is performed when a judgment is made as a successfully diagnosis in step S111 as described above. Then, as known from FIG. 8, when the diagnosis succeeds, the diagnosis item ID and the diagnosis result 6 have been notified to the advice determination unit 119. Therefore, the advice determination unit 119 starts the advice determining process in FIG. 9 which corresponds to the process in step S112 based on the notified diagnosis item ID and diagnosis result.

The flowchart in FIG. 9 illustrates the case in which the diagnosis unit 115 notifies the advice determination unit 119 of the diagnosis item ID of Itm (j) and the diagnosis result of Res(j). The outline of the process in FIG. 9 is described below.

First, in step S301, the advice determination unit 119 notifies the judgment unit 118 of the diagnosis item ID notified from the diagnosis unit 115 (that is, Itm (j)).

Then, in steps S302 through S309, the judgment unit 118 judges the influence degree 8 according to the specified algorithm about the diagnosis item having the diagnosis item ID of Itm(j). The judgment unit 118 notifies the advice determination unit 119 of the judged influence degree 8. In the description below, the influence degree 8 judged corresponding to the j-th diagnosis item is also expressed as Inf(j).

Then, finally, in step S310, the advice determination unit 119 reads the advice corresponding to the combination of the following two from the advice table 306-*j* in the advice storage unit 120.

the diagnosis result 6 notified from the diagnosis unit 115 (that is, Res(j))

the influence degree 8 notified from the judgment unit 118 (that is, Inf(j))

For example, when the advice table 306-*j* illustrated in FIG. 6 is used, assume that the expressions Res(j)=6, Inf(j)=0.25, and m(j)=⅓ hold true. In this case, the advice associated with the combination of Res(j) and Inf(j) is advice Adv(j,2,5). Therefore, in this case, the advice determination unit 119 reads the advice Adv(j,2,5) in step S310. That is, the advice determination unit 119 determines to present a user with the advice Adv(j, 2, 5).

In step S310 the advice determination unit 119 further outputs the read advice to the output control unit 121. Then, the process in FIG. 9 terminates, and then the process in step S113 is executed.

As described above, the judgment of the influence degree 8 in steps S302 through S309 may be appropriately replaced with another judging process depending on the embodiments. In the subsequent third through sixth embodiments, at least a part of steps S302 through 309 are replaced with another judging process.

The processes in steps S302 through S309 according to the second embodiment are described below in detail.

In step S302, the judgment unit 118 refers to the statistical table 305 and acquires the value of the number of times of transfer Cnt.

In step S303, the judgment unit 118 judges whether or not the number of times of transfer Cnt is 0.

When the number of times of transfer Cnt is 0, the driving history of the driver is not stored. Therefore, when the number of times of transfer Cnt is 0, it is assumed that the driver is not affected by the driving experience. Accordingly, when the number of times of transfer Cnt is 0, the judgment unit 118 notifies the advice determination unit 119 that the influence degree Inf(j) is 0 in step S304. After step S304, the process in step S310 described above is performed.

On the other hand, when the number of times of transfer Cnt is larger than 0, the judgment unit 118 performs the processes in and after step S305 to evaluate the degree of influence on the driver from the driving experience.

In step S305, the judgment unit 118 reads the vehicle ID of the vehicle 100 currently being driven by the driver from the history storage unit 117. Concretely, since the driving history table 304-Q corresponds to the current driving of the vehicle 100, the judgment unit 118 reads the value of the field of the vehicle identifier of the driving history table 304-Q.

Furthermore, in step S306, the judgment unit 118 reads the vehicle ID of the vehicle driven immediately before by the driver from the history storage unit 117. The order of performing the processes in steps S305 and S306 may be inverted.

For example, in the driving history tables 304-1 through 304-Q, the driving history number may be a sequence number which increases in order. In this case, in the driving history numbers of the driving history tables 304-1 through 304-Q, the driving history number of the driving history table 304-Q is the largest. In step S306, the judgment unit 118 reads the vehicle ID from the driving history table having the second largest driving history number after the driving history number of the driving history table 304-Q (concretely, the driving history table 304-(Q−1)).

Then, in step S307, the judgment unit 118 judges whether or not the two vehicle IDs read in steps S305 and S306 are equal to each other.

When the two vehicle IDs are equal to each other, the judgment unit 118 next performs the above-mentioned step S304 because the case in which two vehicle IDs are equal to each other indicates the following cases.

The driver has ever driven the vehicle 100.

The driver has not driven other vehicles thereafter, and is now driving the vehicle 100.

Therefore, it is assumed that the influence from the driving experience of other vehicles is zero.

On the other hand, when two vehicle IDs are different, the judgment unit 118 judges in step S308 whether or not the number of times of transfer Cnt is not less than a specified threshold (hereafter referred to as CntMax).

When the number of times of transfer Cnt is not less than the threshold CntMax, the judgment unit 118 next performs the above-mentioned process in step S304 because the case in which the number of times of transfer Cnt is not less than the threshold CntMax refers to the following cases.

The driver has sufficient driving experience.

Therefore, it is estimated that the driver has advanced adaptability (that is, the ability of appropriately driving any type of vehicle by adapting to the feature of each vehicle in a short time.

That is, it is assumed that the driver is hardly affected by the feature of each of the vehicles which the driver have driven before the vehicle 100.

For example, when the driving diagnosis device 110 is equipped into each vehicle leased in the car sharing service, the driver may lease a certain vehicle two or more times, but the driver does not always lease the same vehicle. Therefore, if the number of times of transfer Cnt is large, the number of vehicles the driver has driven tends to be also large. With the tendency, it is expected that when the number of times of transfer Cnt is large, the adaptability of the driver is high. Therefore, the judgment unit 118 judges in step S304 that the influence degree Inf(j) is 0 when the number of times of transfer Cnt is not less than the threshold CntMax.

On the other hand, when the number of times of transfer Cnt is smaller than the threshold CntMax, there is the possibility that the adaptability of the driver is not so high. Therefore, when the number of times of transfer Cnt is smaller than the threshold CntMax, it is preferable to provide a driver with advice by considering the influence from the driving experience of other vehicles the driver has ever driven.

When the number of times of transfer Cnt is smaller than the threshold CntMax, the judgment unit 118 calculates the influence degree 8 (that is, Inf (j)) in a specified method depending on the diagnosis item ID (that is, Itm(j)) in step S309. Then, the judgment unit 118 notifies the advice determination unit 119 of the calculated influence degree Inf(j).

For example, assume that an integer hndl satisfies $1 \leq hndl \leq N$, and the hndl-th diagnosis item in N diagnosis items relates to a steering wheel operation. For example, when the expression j=hndl holds true, the judgment unit 118 may calculate the influence degree Inf(j) (=Inf(hndl)) by the equation (1) in step S309.

$$Inf(hndl)=(curHperform-prevHperform)\times CoefHndl\times Temp \quad (1)$$

The curHperform in equation (1) indicates the steering wheel performance of the vehicle 100 currently being driven by the driver. The judgment unit 118 assigns the value of the steering wheel performance field in the vehicle table having the vehicle ID read in step S305 to the variable curHperform.

The prevHperform in equation (1) indicates the steering wheel performance of another vehicle the driver has driven immediately before. The judgment unit 118 assigns the value of the steering wheel performance field of the vehicle table having the vehicle ID read in step S306 to the variable prevHperform.

The CoefHndl in equation (1) is a coefficient. The coefficient CoefHndl is a constant in the second embodiment.

Whether the coefficient CoefHndl is positive or negative depends on whether the influence on the diagnosis result 6 about the steering wheel operation from the driving history is positive or negative when the steering wheel performance of the vehicle currently being driven by the driver is higher than the steering wheel performance of the vehicle the driver has driven immediately before. Whether the influence is positive or negative refers to, in other words, whether the value of the diagnosis result 6 increases or decreases by the influence of the driving history.

To determine whether the coefficient CoefHndl is positive or negative, a preliminary experiment may be conducted. For example, two vehicles having different steering wheel performance may be driven by a test driver. Otherwise, a driving simulator may be used instead of an actual vehicle.

However, the absolute value of the coefficient CoefHndl may be arbitrarily determined because a different advice table is provided for each diagnosis item, and because the influence degree Inf(hndl) is used only when the advice determination unit 119 refers to the advice table for the hndl-th diagnosis item, and is not used when the advice determination unit 119 refers to the advice table for other diagnosis items. A threshold (m(j) etc. in FIG. 6) for delimiting the ranges of the degree of influence in the advice table may be determined depending on the arbitrarily determined absolute value of the coefficient CoefHndl.

In some embodiments, the coefficient CoefHndl may be expressed by a certain function. Furthermore, the judgment unit 118 may select the value of the coefficient CoefHndl from among some candidate values depending on other variables (described later in detail with reference to FIG. 10).

Some factors affect the degree of the adaptability of the driver to the vehicle 100 currently being driven by the driver.

An example of the factors is the specification of a vehicle such as the above-mentioned steering wheel performance. The factors include a temporal factor.

An example of a temporal factor includes a start-of-driving time, a driving time, etc. From a certain point of view, the number of times of transfer Cnt is also a type of temporal factor because the number of times of transfer Cnt is a type of summary of the driving history, and changes (concretely, increases) with the lapse of time.

The degree of the adaptability of the driver to the vehicle 100 currently being driven by the driver depends on the temporal factor. The more the driver is adapted to the vehicle 100 currently being driven by the driver, the closer to 0 the influence degree 8 becomes. That is, the magnitude of the influence degree 8 depends on the temporal factor. The multiplication of the Temp in equation (1) indicates that the magnitude of the influence degree 8 depends on the temporal factor.

In the second embodiment, the variable Temp is a function of the number of times of transfer Cnt. In another embodiment described later, the variable Temp is a function of another parameter than the number of times of transfer Cnt.

For example, the variable Temp may be defined by, for example, equation (2).

$$\mathrm{Temp} = \begin{cases} 0 & (Cnt = 0) \\ \dfrac{Cnt\mathrm{Max} - Cnt}{Cnt\mathrm{Max}} \times CoefCnt & (0 < Cnt < Cnt\mathrm{Max}) \\ 0 & (Cnt\mathrm{Max} \leq Cnt) \end{cases} \quad (2)$$

The CoefCnt in equation (2) is an arbitrary positive coefficient. The coefficient CoefCnt is a constant in the second embodiment, but the coefficient CoefCnt itself may be expressed by a certain function. Furthermore, depending on another variable, the coefficient CoefCnt may be selected from among some candidate values (described later in detail with reference to FIG. 10).

The case of Cnt=0 in the definition in equation (2) corresponds to the route from step S303 to step S304 in FIG. 9. The case of CntMax≤Cnt in the definition in equation (2) corresponds to the route from step S308 to step S304 in FIG. 9.

The magnitude of the influence degree Inf(hndl) calculated by equations (1) and (2) monotonically increases with respect to the magnitude of the difference in steering wheel performance (that is, the difference in specification). Furthermore, when the number of times of transfer Cnt is positive, the magnitude of the influence degree Inf(hndl) calculated by equations (1) and (2) monotonically decreases with respect to the number of times of transfer Cnt. Obviously, using another function which satisfies the following three conditions, the judgment unit 118 may calculate the influence degree Inf(hndl).

The magnitude of the influence degree Inf(hndl) monotonically increases with respect to the difference in steering wheel performance.

If the number of times of transfer Cnt is 0, the influence degree Inf(hndl) is 0.

If the number of times of transfer Cnt is positive, the magnitude of the influence degree Inf(hndl) monotonically decreases with respect to the number of times of transfer Cnt.

Next, further two examples are explained below relating to the method of calculating the influence degree Inf(j) depending on the diagnosis item in step S309.

For example, assume that a certain integer pos satisfies the expression 1≤pos≤N, and the pos-th diagnosis item in N diagnosis items is related to the running position on the lane. For example, when the expression j=pos holds true, the judgment unit 118 may calculate the influence degree Inf(j) (=Inf(pos)) by equation (3) in step S309.

$$\mathrm{Inf(pos)} = (\mathrm{curCW} - \mathrm{prevCW}) \times \mathrm{CoefPos} \times \mathrm{Temp} \quad (3)$$

The curCW in equation (3) indicates the total width of the vehicle 100 currently being driven by the driver. The judgment unit 118 assigns the value of the total width field in the vehicle table having the vehicle ID read in step S305 to the variable curCW.

The prevCW in equation (3) indicates the total width of another vehicle the driver has driven immediately before. The judgment unit 118 assigns the total width field in the vehicle table having the vehicle ID read in step S306 to the variable prevCW.

The CoefPos in equation (3) is a coefficient. The coefficient CoefPos is a constant in the second embodiment.

Whether the coefficient CoefPos is positive or negative depends on whether the influence of the driving history on the diagnosis result 6 relating the running position is positive or negative when the width of the vehicle currently being driven by the driver is larger than the width of the vehicle the driver has driven immediately before. To determine whether the coefficient CoefPos is positive or negative, a preliminary experiment may be conducted. However, the absolute value of the coefficient CoefPos may be arbitrarily determined.

In some embodiments, the coefficient CoefPos itself may be expressed by a certain function. Furthermore, the judgment unit 118 may select a value of the coefficient CoefPos from among some candidate values depending on another variable.

The Temp in equation (3) is similar to Temp in equation (1). Equation (3) may be replaced with another function which defines the influence degree Inf(pos) so that the magnitude of the influence degree Inf(pos) monotonically increases with respect to the magnitude of the difference in vehicle width.

For example, assume that an integer acc satisfies the expression 1≤acc≤N, and the acc-th diagnosis item in N diagnosis items relates to acceleration. For example, when j=acc holds true, the judgment unit 118 may calculate the influence degree Inf(j) (=Inf(acc)) by equation (4) in step S309.

$$\mathrm{Inf(acc)} = (\mathrm{curWeight}/\mathrm{curPperform} - \mathrm{prevWeight}/\mathrm{prevPperform}) \times \mathrm{CoefAcc} \times \mathrm{Temp} \quad (4)$$

The curWeight in equation (4) indicates the weight of the vehicle 100 currently being driven by the driver. The judgment unit 118 assigns the value of the vehicle weight field of the vehicle table having the vehicle ID read in step S305 to the variable curcurWeight.

The curPperform in equation (4) indicates the engine output capability of the vehicle 100 currently being driven by the driver. The judgment unit 118 assigns the value of the engine output capability field of the vehicle table having the vehicle ID read in step S305 to the variable curPperform.

The prevWeight in equation (4) indicates the weight of another vehicle the driver has driven immediately before. The judgment unit 118 assigns the value of the vehicle width field of the vehicle table having the vehicle ID read in step S306 to the variable prevWeight.

The prevPperform in equation (4) indicates the engine output capability of another vehicle the driver has driven immediately before. The judgment unit 118 assigns the value of the engine output capability field of the vehicle table having the vehicle ID read in step S306 to the variable prevPperform.

The CoefAcc in equation (4) is a coefficient. The coefficient CoefAcc is a constant in the second embodiment. In some embodiments, the coefficient CoefAcc itself may be expressed by a certain function. Furthermore, the judgment unit 118 may select the value of the coefficient CoefAcc from among some candidate values depending on another variable.

The Temp in equation (4) is similar to Temp in equation (1).

For example, the engine output capability may be expressed by the maximum output. In this case, equation (4) indicates that the magnitude of the influence degree Inf (acc) monotonically increases with respect to the difference in weight-to-power ratio. In this case, whether the coefficient CoefAcc is positive or negative depends on whether the influence on the diagnosis result 6 about the acceleration from the driving history is positive or negative when the weight-to-power ratio of the vehicle currently being driven by the driver is higher than the weight-to-power ratio of another vehicle the driver has driven immediately before. A preliminary experiment may be conducted to determine whether the coefficient CoefAcc is positive or negative. However, the absolute value of the coefficient CoefAcc may be arbitrarily determined. Obviously, equation (4) may be replaced with another equation which defines the influence degree Inf(acc) so that the magnitude of the influence degree Inf(acc) may monotonically increase with respect to the magnitude of the difference in weight-to-power ratio.

The judgment unit 118 judges the influence degree 8 in the method depending on the diagnosis item in step S309 in FIG. 9 as exemplified with reference to equations (1) through (4) above.

Then, the third embodiment is described below. In the third embodiment, the judgment unit 118 calculate the influence degree 8 by equation (5) instead of equation (2). Concretely, in the third embodiment, the process in step S308 of the advice determining process in FIG. 9 is varied as described below. In other points, the third embodiment is similar to the second embodiment.

$$\text{Temp} = \begin{cases} \dfrac{cTime\text{Max} - cTime}{cTime\text{Max}} \times CoefCurTime & (cTime < cTime\text{Max}) \\ 0 & (cTime\text{Max} < cTime) \end{cases} \quad (5)$$

The cTime in equation (5) indicates the driving time that has elapsed from the start of the driving of the vehicle 100 currently being driven by the driver. The cTimeMax in equation (5) is a positive threshold determined in advance with respect to the driving time cTime. The threshold cTimeMax may be determined based on a preliminary experiment of observing a change with time of the diagnosis result 6. The threshold cTimeMax indicates that how long in time it is for the driver to ignore the influence of driving experience of other vehicles the driver has driven from the start of the driver driving a certain vehicle.

the CoefCurTime in equation (5) is an arbitrary positive coefficient. The coefficient CoefCurTime is a constant in the third embodiment. In some embodiments, the coefficient CoefCurTime itself may be expressed by a certain function. Furthermore, the judgment unit 118 may select the value of the coefficient CoefCurTime from among some candidate values depending on other variables.

The magnitude of the influence degree Inf(hndl) calculated by equations (1) and (5) monotonically increases with respect to the magnitude of the difference in steering wheel performance, and monotonically decreases with respect to the length of the driving time cTime. Furthermore, the magnitude of the influence degree Inf(pos) calculated by equations (3) and (5) monotonically increases with respect to the magnitude of the difference in vehicle width, and monotonically decreases with respect to the length of the driving time cTime. The magnitude of the influence degree Inf(acc) calculated by equations (4) and (5) monotonically increases with respect to the magnitude of the difference in weight-to-power ratio, and monotonically decreases with respect to the length of the driving time cTime. The judgment unit 118 may replace equation (5) with another equation which defines the Temp so that the magnitude of the Temp may monotonically decrease with respect to the length of the driving time cTime.

As described above, in the third embodiment, the process in step S308 in the advice determining process in FIG. 9 according to the second embodiment is varied. Concretely, in the third embodiment, the judgment unit 118 performs the following process instead of the judgment in step S308.

The judgment unit 118 reads the value of the driving time field from the driving history table 304-Q (that is, the driving history table about the driving of the current vehicle 100). The thus read value is used as the driving time cTime in equation (5).

Next, the judgment unit 118 judges whether or not the driving time cTime is not less than the threshold cTimeMax.

When the driving time cTime is not less than the threshold cTimeMax, the expression Temp=0 holds true by equation (5), thereby holding the influence degree Inf (j) as 0. Therefore, the driving time cTime is not less than the threshold cTimeMax, the judgment unit 118 performs the process in step S304. That is, when the driving time cTime is not less than the threshold cTimeMax, the judgment unit 118 notifies the advice determination unit 119 that the influence degree Inf(j) is 0.

On the other hand, when the driving time cTime is smaller than the threshold cTimeMax, the judgment unit 118 performs the process in step S309. In step S309 in the third embodiment, as described above, the judgment unit 118 uses equation (5) not equation (2) in calculating the value Temp relating to the temporal factor.

For example, when the expression j=hndl holds true, the judgment unit 118 may calculate the influence degree Inf(j) (=Inf(hndl)) by equations (1) and (5) in step S309. When the expression j=pos holds true, the judgment unit 118 may calculate the influence degree Inf(j) (=Inf(pos)) by equations (3) and (5). Otherwise, when the expression j=acc holds true, the judgment unit 118 may calculate the influence degree Inf(j) (=Inf(acc)) by equations (4) and (5) in step S309.

Next, the fourth embodiment is described below. In the fourth embodiment, the judgment unit 118 calculates the influence degree 8 using equation (6) instead of equation (2). Concretely, in the fourth embodiment, the process in step S308 of the advice determining process in FIG. 9 is varied as described below. In other points, the fourth embodiment is similar to the second embodiment.

$$\text{Temp} = \begin{cases} \dfrac{Intv\text{Max} - Intv}{Intv\text{Max}} \times CoefIntv & (Intv < Intv\text{Max}) \\ 0 & (Intv\text{Max} \leq Intv) \end{cases} \quad (6)$$

The Intv in equation (6) indicates the interval from the end of the driver driving another vehicle to the start of the driver driving the vehicle 100. The IntvMax in equation (6) is a positive threshold specified for the interval Intv. The interval Intvmax may be, for example, determined based on a preliminary experiment. The interval Intvmax indicates that how long in time it is for the driver to ignore the influence of driving experience of other vehicles the driver has driven from the start of the driver driving a certain vehicle. That is, the interval Intvmax indicates the elapse of time to be taken to allow a driver to forget the driving sense for the feature of a certain vehicle from the end of the driver driving the vehicle.

The CoefIntv in equation (6) is a coefficient. The coefficient CoefIntv is a constant in the fourth embodiment. In some embodiments, the coefficient CoefIntv itself may be expressed by a certain function. Furthermore, depending on the value of another variable, the judgment unit 118 may select the value of the coefficient CoefIntv from among some candidate values.

The magnitude of the influence degree Inf(hndl) calculated by equations (1) and (6) monotonically increases with respect to the magnitude of the difference in steering wheel performance, and monotonically decreases with respect to the length of the interval Intv. The magnitude of the influence degree Inf(po) calculated by equations (3) and (6) monotonically increases with respect to the magnitude of the difference in vehicle width, and monotonically decreases with respect to the length of the interval Intv. Then, the magnitude of the influence degree Inf(acc) calculated by equations (4) and (6) monotonically increases with respect to the magnitude of the difference in weight-to-power ratio, and monotonically decreases tai the interval Intv. The judgment unit 118 may replace equation (6) with another equation which defines the Temp so that the magnitude of the Temp may monotonically decrease with respect to the interval Intv.

As described above, in the fourth embodiment, the process in step S308 of the advice determining process in FIG. 9 according to the second embodiment is varied. Concretely, in the fourth embodiment, the judgment unit 118 replaces the judgment with the following process.

The judgment unit 118 reads the driving start date and time and the driving time from the driving history table having the second largest driving history number after the driving history number in the driving history table 304-Q in the driving history tables 304-1 through 304-Q. Then, the judgment unit 118 adds the driving time to the driving start date and time, thereby calculating the end-of-driving date and time at which the driver terminated another vehicle which was driven by the driver immediately before the vehicle 100.

The judgment unit 118 also reads the driving start date and time from the driving history table 304-Q (that is, the driving history table relating to the vehicle 100 currently being driven by the driver. The judgment unit 118 calculates the interval Intv in equation 86) by subtracting the end-of-driving date and time calculated as described above.

Then, the judgment unit 118 compares the interval Intv with the interval Intvmax. When the interval Intv is not less than the interval Intvmax, the judgment unit 118 performs the process in step S304. That is, when the interval Intv is not less than the interval Intvmax, the judgment unit 118 notifies the advice determination unit 119 that the influence degree Inf(j) is 0.

On the other hand, when the interval Intv is smaller than the interval Intvmax, the judgment unit 118 performs the process in step S309. However, in step S309 in the fourth embodiment, the judgment unit 118 uses equation (6) not equation (2) in calculating the value Temp relating to the temporal factor.

For example, in the case of j=hndl, the judgment unit 118 may calculate the influence degree Inf(j) (=Inf (hndl)) by equations (1) and (6). Furthermore in the case of j=pos, the judgment unit 118 may calculate the influence degree Inf(j) (=Inf(pos)) by equations (3) and (6) in step S309. Otherwise, in the case of j=acc, the judgment unit 118 may calculate the influence degree Inf(j) (=Inf(acc)) by equations (4) and (6) in step S309.

The fourth embodiment may be varied relating to the definition of the interval Intv. Concretely, the interval Intv may be the elapsed time from the end of the driver driving another vehicle.

Thus, when the fourth embodiment is varied, the judgment unit 118 reads not only the driving start date and time but also the driving time from the driving history table 304-Q (that is, the driving history table relating to the vehicle 100 currently being driven by the driver. Then, the judgment unit 118 adds the driving time of the vehicle 100 to the driving start date and time of the vehicle 100.

The time obtained by the addition above is substantially equal to the current time. Therefore, the judgment unit 118 may read the current time from the clock 112.

The judgment unit 118 subtracts the end-of-driving date and time at which the driver terminated driving another vehicle driven by the driver immediately before the vehicle 100 from the time obtained by the addition (or the time read from the clock 112). By the subtraction, the judgment unit 118 may calculate the interval Intv.

Then, the fifth embodiment is described below. According to the fifth embodiment, the judgment unit 118 calculates the influence degree 8 by equation (7) instead of equation (2). Concretely, in the fifth embodiment, the process of the advice determining process in FIG. 9 in step S308 is varied as follows. In other points, the fifth embodiment is similar to the second embodiment.

$$\text{Temp} = \begin{cases} 0 & (pTime \le pTime\text{Max}) \\ \dfrac{pTime - pTime\text{Max}}{pTime} \times CoefPrevTime & (pTime\text{Max} < pTime) \end{cases} \quad (7)$$

The pTime in equation (7) indicates the driving time when the driver drove another vehicle immediately before. The pTimeMax in equation (7) is a positive threshold specified for the driving time pTime. The threshold pTimeMax may be determined based on a preliminary experiment such as observing a change with time in the diagnosis result 6. The threshold pTimeMax indicates generally how long it is estimated from the driver driving a certain vehicle which the driver has not driven before to the start of a change in driving sense of the driver depending on the feature of the certain vehicle.

When the driver drives a certain vehicle, the longer the driving time, the more adapted the driver become to the certain vehicle, and the more affected the driving sense become by the feature of the certain vehicle. However, in driving for a short time, the driving sense of the driver does not change very much. Therefore, the influence on the driver from the driving for a short time may be ignored. The threshold pTimeMax indicates a short driving time in which the influence on the driving sense of the driver may be ignored.

The CoefPrevTime in equation (7) is a positive coefficient. The coefficient CoefPrevTime is a constant in the fifth embodiment. In some embodiments, the coefficient CoefPrevTime itself may be a certain function. Furthermore, the judgment unit 118 may select the value of the coefficient CoefPrevTime from among some candidate values depending on another variable.

The magnitude of the influence degree Inf(hndl) calculated by equations (1) and (7) monotonically increases with respect to the magnitude of the difference in steering wheel performance, and also monotonically increases with respect to the length of the driving time pTime. Furthermore, the magnitude of the influence degree Inf (pos) calculated by equations (3) and (7) monotonically increases with respect to the magnitude of the difference in vehicle width, and also monotonically increases with respect to the length of the driving time pTime. Then, the magnitude of the influence degree Inf(acc) calculated by equations (4) and (7) monotonically increases with respect to, for example, the magnitude of the difference in weight-to-power ratio, and also monotonically increases with respect to the length of the driving time pTime. The judgment unit 118 may use another equation which defines the Temp instead of equation (7) so that the magnitude of the Temp may monotonically increase with respect to the length of the driving time pTime.

As described above, in the fifth embodiment, the process of the advice determining process in step S308 in FIG. 9 in the second embodiment is varied. Concretely, the judgment unit 118 performs the following process instead of the judgment in step S808.

The judgment unit 118 reads the driving time from the driving history table having the next largest driving history number after the driving history number of the driving history table 304-Q in the driving history tables 304-1 through 304-Q. The thus read driving time is used as the driving time pTime in equation (7).

Next, the judgment unit 118 judges whether or not the driving time pTime is not more than the threshold pTimeMax.

When the driving time pTime is not more than the threshold pTimeMax, the expression emp=0 holds true by equation (7). Therefore, the influence degree Inf(j) is also 0. Accordingly, when the driving time pTime is not more than threshold pTimeMax, the judgment unit 118 performs the process in step S304. That is, when the driving time pTime is not more than the threshold pTimeMax, the judgment unit 118 notifies the advice determination unit 119 that the influence degree Inf(j) is 0.

On the other hand, when the driving time pTime is larger than the threshold pTimeMax, the judgment unit 118 performs the process in step S309. In step S309 in the fifth embodiment, the judgment unit 118 uses equation (7) instead of equation (2) in calculating the value Temp relating to the temporal factor.

For example, in the case of j=hndl, the judgment unit 118 may calculate the influence degree Inf(j) (=Inf(hndl)) by equations (1) and (7) in step S309. In the case j=pos, the judgment unit 118 may calculate the influence degree Inf(j) (=Inf(pos)) by equations (3) and (7) in step S309. Otherwise, in the case of j=acc, the judgment unit 118 may calculate the Inf(j) (=Inf(acc)) by equations (4) and (7) in step S309.

Next, the sixth embodiment is described. In the sixth embodiment, the judgment unit 118 calculates the influence degree 8 using equation (8) instead of equation (2). Concretely, in the sixth embodiment, the process of the advice determining process in step S308 in FIG. 9 is varied as described below. In other points, the sixth embodiment is similar to the second embodiment.

$$\text{Temp} = \begin{cases} 0 & (LgTime \leq LgTimeMax) \\ \dfrac{LgTime - LgTimeMax}{LgTime} \times CoefLgTime & (LgTimeMax < LgTime) \end{cases} \quad (8)$$

The LgTime in equation (8) may be the longest driving time in the driving time of all vehicles other than the vehicle 100 the driver has ever driven. Otherwise, the LgTime may be the longest driving time in the driving time of the entire vehicles within latest driven L vehicles in the vehicles the driver has ever driven (L indicates a constant not less than 2).

The LgTimeMax in equation (8) is a positive threshold specified for the driving time LgTime. The driving time LgTime may be determined based on a preliminary experiment of, for example, observing the change with time of the diagnosis result 6. The threshold LgTimeMax indicates generally how long it is estimated from the driver driving a certain vehicle which the driver has not driven before to the driver obtaining the driving sense adapted to the feature of the certain vehicle.

When the driver drives a certain vehicle, the longer the driving time, the more adapted the driver become to the certain vehicle, and the more affected the driving sense become by the feature of the certain vehicle. It is assumed that the driver who has driven a certain vehicle for a long time is planted with a strong driving sense with adaptability to the features of the certain vehicle. Then, it is also assumed that the planted driving sense is not easily changed when the driver next drives another vehicle. The threshold LgTimeMax indicates the long driving time in which the driving sense adapted to the features of a certain vehicle is fixed to a driver.

The CoefLgTime in equation (8) is a positive coefficient. The coefficient CoefLgTime is a constant in the sixth embodiment. In some embodiments, the coefficient CoefLgTime itself may be expressed by a certain function. Furthermore, depending on the value of another variable, the judgment unit 118 may select the value of the coefficient CoefLgTime from among some candidate values. For example, the coefficient CoefLgTime may be a positive and variable constant defined so that it may monotonically decrease with respect to the length of time elapsed from the driver completing driving a vehicle over the driving time LgTime.

The magnitude of the influence degree Inf(hndl) calculated by equations (1) and (8) monotonically increases with respect to the magnitude of the difference in steering wheel performance, and also monotonically increases with respect to the length of the driving time LgTime. The magnitude of the influence degree Inf(pos) calculated by equations (3) and (8) monotonically increases with respect to the magnitude of the difference in vehicle width, and also monotonically increases with respect to the length of the driving time LgTime. The magnitude of the influence degree Inf(acc) calculated by equations (4) and (8) monotonically increases with respect to the magnitude of the difference in weight-to-power ratio, and also monotonically increases with respect to the length of the driving time LgTime. The judgment unit 118 may replace equation (8) with another equation which defines the Temp so that the magnitude of the Temp may monotonically increase with respect to the length of the driving time LgTime.

As described above, in the sixth embodiment, step S308 of the advice determining process in FIG. 9 according to the second embodiment is varied. Concretely, in the sixth embodiment, the judgment unit 118 performs the following process instead of the judgment in step S308.

The judgment unit 118 reads the maximum value in the driving time in the driving history tables 304-1 through 304-(Q−1). Otherwise, the judgment unit 118 reads the maximum value of the driving time in a maximum of L driving history tables in order from the larger driving history number from the driving history tables 304-1 through 304-Q. The thus read driving time is used as the driving time LgTime in equation (8).

Next, the judgment unit 118 judges whether or not the driving time LgTime is not more than the threshold LgTimeMax.

When the driving time LgTime is not more than the threshold LgTimeMax, the expression Temp=0 holds true by equation (8). Therefore, the influence degree Inf(j) is also 0. Accordingly, when the driving time LgTime is not more than the threshold LgTimeMax, the judgment unit 118 performs the process in step S304. That is, when the driving time LgTime is not more than the threshold LgTimeMax, the judgment unit 118 notifies the advice determination unit 119 that the influence degree Inf(j) is 0.

On the other hand, when the driving time LgTime is larger than the threshold LgTimeMax, the judgment unit 118 performs the process in step S309. In step S309 in the sixth embodiment, as described above, the judgment unit 118 uses equation (8) instead of equation (2) in calculating the Temp relating to the temporal factor.

For example, when j=hndl holds true, the judgment unit 118 may calculate the influence degree Inf(j) (=Inf(hndl)) by equations (1) and (8) in step S309. Furthermore, when the expression j=pos holds true, the judgment unit 118 may calculate the influence degree Inf(j) (=Inf(pos)) by equations (3) and (8) in step S309. Otherwise, when j=acc holds true, the judgment unit 118 may calculate the influence degree Inf(j) (=Inf(acc)) by equations (4) and (8) in step S309.

As described above, various coefficients may be constants and may be expressed by functions. For example, they may be expressed by a function. A plurality of candidates of a coefficient may be stored in the coefficient table as exemplified in FIG. 10. The judgment unit 118 reads appropriate coefficient value from a coefficient table depending on the combination of the values of parameters (for example, a combination of a steering wheel performance and the number of times of transfer), and calculate the influence degree 8 using the read coefficient value.

FIG. 10 concretely exemplifies a coefficient table 401 for a coefficient CoefHndl in equation (1), and a coefficient table 402 for a coefficient CoefCnt in equation (2). the coefficient tables 401 and 402 are stored in the storage device accessible from the judgment unit 118 (for example, the RAM 202 o the non-volatile storage device 203).

The coefficient table 401 is a table which holds H×C candidates for the value of the coefficient CoefHndl in a matrix format. For convenience of explanation below, the minimum value and the maximum value which are assumed as the values indicating the steering wheel performance are referred to as HperformMin and HperformMax respectively.

In the coefficient table 401, H values are sampled as the difference in steering wheel performance (curHperform−prevHperform) (1<H). The minimum value of the H values is a negative value (HperformMin−HperformMax), and the maximum value of H values is a positive value (HperformMax−HperformMin).

In the coefficient table 401, C values from CntFew to CntMany are sampled (1<C) as the number of times of transfer Cnt. For example, when CntFew=0 and CntMany=6 hold true, C=7 or 1<C<7 may hold true.

In the coefficient table 401, the candidate value cHndl(c, h) of the coefficient CoefHndl (where 1≤C and 1≤h≤H) is stored for each of H×C combinations of the steering wheel performance and the number of times of transfer.

The coefficient table 402 holds H×C candidates for the value of the coefficient CoefCnt in a matrix format. Also in the coefficient table 402, as with the coefficient table 401, the candidate value cCnt(c, h) for the value of the coefficient CoefCnt is stored for each of H×C combinations of the difference in steering wheel performance and the number of times of transfer (where 1≤c≤C and 1≤h≤H).

For example, although the advice determining process is performed according to the flowchart in FIG. 9 in the second embodiment, the second embodiment may be varied to use the coefficient tables 401 and 402. In this case, the judgment unit 118 may read the candidate value cHndl(c, h) corresponding to the combination of the following two values as the value of the coefficient CoefHndl from the coefficient table 401 in step S309. Similarly, the judgment unit 118 may read the candidate value cCnt(c, h) corresponding to the combination of the following two values as the value of the coefficient CoefCnt from the coefficient table 402 in step S309.

The difference between the value curHperform of the steering wheel performance stored in the vehicle table having the vehicle ID read in step S305, and the value prevHperform of the steering wheel performance stored in the vehicle table having the vehicle ID read in step S306.

The number of times of transfer Cnt read in step S302.

Then, the judgment unit 118 may calculate the influence degree Inf(j) in step S309 by equations (1) and (2) using the read values cHndl(c,h) and cCnt(c,h). The judgment unit 118 may determine the value of the coefficient CoefHndl by the interpolation (for example, linear interpolation) using two or more candidate values in the coefficient table 401. Similarly, the judgment unit 118 may determine the value of the coefficient CoefCnt by the interpolation (for example, linear interpolation) using two or more candidate values in the coefficient table 402.

Relating to the coefficient other than the coefficient CoefHndl and coefficient CoefCnt, a similar coefficient table may be used. That is, a coefficient table which holds a candidate value for each of the combinations of the difference in specification between two vehicles and the value indicating a temporal factor may also be used for other coefficients.

Furthermore, to adjust the method of changing the influence degree 8 on the value of a certain parameter (for example, Cnt), the coefficient itself may be defined by an appropriate function using the parameter as an argument. Similarly, to adjust the method of changing the influence degree 8 for the value calculated from two or more parameters (for example, curHperform−prevHperform), the coefficient itself may be defined by an appropriate coefficient using the value as an argument. For example, an appropriate function may be selected for adjustment for a linear change of the influence degree 8 for the parameter (or the value calculated from two or more parameters).

Although equations (1), (3), and (4) include the multiplication of the variable Temp, the multiplication may be replaced with an addition depending on the embodiments. For example, equation (9) may be used $$\mathrm{Inf}(j) = \begin{cases} 0 & (\mathrm{Diff}(j) = 0) \\ \mathrm{Diff}(j) + \mathrm{Temp} & (\mathrm{Diff}(j) \neq 0) \end{cases} \quad (9)$$

The Temp in equation (9) may be calculated by equations (2), and (5) through (8). The value of each coefficient in equations (2), (5) through (8) is not always positive, but may be negative when it is used to define Temp in equation (9).

The addition in equation (9) indicates that the following two events are independently evaluated.

Whether the influence of the difference in specification between vehicles on the diagnosis result 6 is positive or negative Whether the influence of the temporal factor on the diagnosis result 6 is positive or negative Therefore, in the embodiment in which equation (9) is used, when the influence of the temporal factor on the diagnosis result 6 is negative, the value of each coefficient in equations (2), (5) through (8) is negative.

The Diff (j) in equation (9) is the value obtained by multiplying the difference between the vehicles having the values indicating the specification having the influence on the diagnosis result 6 of the j-th diagnosis item by a coefficient. Three examples of Diff (j) are listed below.

$$\mathrm{Diff(hndl)}=(\mathrm{curHperform}-\mathrm{prevHperform})\times\mathrm{CoefHndl} \quad (10)$$

$$\mathrm{Diff(pos)}=(\mathrm{curCW}-\mathrm{prevCW})\times\mathrm{CoefPos} \quad (11)$$

$$\mathrm{Diff(acc)}=(\mathrm{curWeight}/\mathrm{curPperform}-\mathrm{prevWeight}/\mathrm{prevPperform})\times\mathrm{CoefAcc} \quad (12)$$

The meaning of each symbol on the right of equations (10) through (12) is similar to that in equations (1), (3), and (4).

In the embodiments in which equations (9) through (12) are used, it is preferable that the absolute value of a coefficient is appropriately determined depending on the magnitude of the contribution to the influence degree 8 from the difference in specification between the vehicles and the magnitude of the contribution to the influence degree 8 from the temporal factor.

For example, for the influence degree 8 relating to a certain diagnosis item, the difference in specification between the vehicles is dominant, and the fluctuation of the influence degree 8 by the temporal factor may be small. In this case, it is preferable that the absolute value of the coefficient used in calculating the Diff (j) is set larger than the absolute value of the coefficient used in calculating the Temp.

On the other hand, for the influence degree 8 relating to another diagnosis item, the temporal factor may be dominant. In this case, it is preferable that the absolute value of the corresponding used in calculating the Diff (j) is set larger than the absolute value of the coefficient used in calculating the Temp.

As described above, the advice table 306-*j* is provided for each diagnosis item. Therefore, there is a case that the range of the possible value of the influence degree 8 between the diagnosis items is not normalized. Accordingly, the absolute value of each coefficient may be arbitrarily determined.

Described next is the seventh embodiment. In the seventh embodiment, the format of an advice table is varied. FIG. 11 is an example of an advice table according to the seventh embodiment. Each of the second through sixth embodiments may be varied so that an advice table including a diagnosis result field as exemplified in FIG. 11 is used. For convenience of explanation below, the seventh embodiment is described as an embodiment varied from the second embodiment.

As well known by comparing FIG. 6 with FIG. 11, a prior diagnosis result field is added to an advice table 307-*j*. That is, in the advice table 307-*j*, each advice is associated with a combination of the following three values.

the latest diagnosis result Res(j) on the j-th diagnosis item the influence degree Inf(j) on the j-th diagnosis item the prior diagnosis result on the j-th diagnosis item (hereafter referred to as Prev(j))

The combination of the latest diagnosis result Res(j), the influence degree Inf(j), and the prior diagnosis result Prev(j) may be concretely expressed by a combination of a set of valued as follows.

A set of values indicating the latest diagnosis result Res(j) (for example, the range of value).

A set of values indicating the influence degree Inf (j) (for example, the range of a value)

A set of values indicating the prior diagnosis result Prev(j) (for example, the range of a value)

Furthermore, the number of ranges into which the values of the latest and prior diagnosis results 6 are classified may be optionally determined depending on the diagnosis item. Similarly, the number of ranges into which the values of the influence degree 8 are classified may be arbitrarily determined depending on the diagnosis item. The value of the boundary between the ranges may be arbitrarily determined depending on the diagnosis item.

Relating to another vehicle the driver has driven immediately before the vehicle 100 currently being driven by the driver (hereafter referred to also as the prior vehicle), the result of the diagnosis obtained by the diagnosis unit 115 of the driving diagnosis device 110 equipped into the prior vehicle may be used as a prior diagnosis result. When the diagnosis unit 115 conducts a diagnosis twice or more on the prior vehicle, a statistic which represents two or more diagnosis results 6 is used as a prior diagnosis result.

The type of statistic suitable for representing the diagnosis result 6 depends on the diagnosing method for each diagnosis item. For example, in the statistic such as an average value, a mode value, a maximum value, a minimum value, etc., it is preferable that a suitable type of statistic is used depending on the diagnosis item. The prior diagnosis result field for each of three diagnosis items exemplified in the driving history table in FIG. 5 stores an appropriate statistic as described above. The statistic is concretely calculated by the history management unit 116 as explained above with reference to step S206 in FIG. 8.

When the prior diagnosis result defined above is used in the advice table 307-*j*, the judgment unit 118 of the driving diagnosis device 110 equipped into the vehicle 100 notifies the advice determination unit 119 of not only the influence degree Inf(j) but also the prior diagnosis result Prev(j). Concretely, the judgment unit 118 operates as follows.

When the judgment unit 118 judges in step S303 that the number of times of transfer Cnt is 0, it notifies in step S304 the advice determination unit 119 that the influence degree Inf(j) is 0 and the prior diagnosis result Prev(j) is undefined.

On the other hand, when the number of times of transfer Cnt is once or more, the judgment unit 118 reads not only the vehicle ID, but also the prior diagnosis result on the j-th diagnosis item from the driving history table 304-(Q−1) in step S306. Then, the judgment unit 118 notifies the advice determination unit 119 of the influence degree Inf(j) with the prior diagnosis result when it notifies the advice determination unit 119 of the influence degree Inf(j).

Then, in step S310, the advice determination unit 119 reads the advice associated with the combination of the following three values from the advice table 307-*j*.

the latest diagnosis result Res(j) notified from the diagnosis unit 115 in step S204 in FIG. 8 the influence degree Inf (j) notified from the judgment unit 118 in step S304 or S309 in FIG. 9 the prior diagnosis result Prev(j) notified from the judgment unit 118 in step S304 or S309 in FIG. 9

In step S310, the advice determination unit 119 further outputs the read advice to the output control unit 121.

For simple explanation, the explanation of step S105 in FIG. 7 is omitted in the explanation above. However, in step S105, there is the possibility that the history management unit 116 fails in acquiring the driving history table on the driving history. For example, depending on the situation, there is the possibility that the communication between the vehicle 100 and the server 230 fails. There is also the possibility that a part or all of the data on the storage medium 240 becomes unreadable for any reason.

Therefore, although the driver has actually driven one or more vehicles, the history management unit 116 does not always successfully acquire a driving history table on the driving history from the external device 130 (concretely, the server 230 or the storage medium 240). Although the driving history table of the driving history is acquired from the history management unit 116, the prior diagnosis result data in the acquired driving history table may be invalid for any reason (for example, destroyed or null).

Therefore, when the advice table in the format illustrated in FIG. 11 is used, advice may be defined when the prior diagnosis result is undefined.

When the communication between the history management unit 116 and the server 230 fails in step S105, the history management unit 116 may tries the communication with the server 230 again. However, there is the possibility that the driving diagnosing process in step S110 and the advice determining process in step S112 may be performed before the history management unit 116 succeeds the communication as a result of one or more retrials. That is, although retrials are performed once or more, the data of the prior diagnosis results is not always available in the advice determining process.

According to the definition of the prior diagnosis result, the prior diagnosis result is undefined, for example, in the following cases.

The driver has not driven another vehicle into which the driving diagnosis device 110 is equipped. Therefore, there is no prior diagnosis result data in the history storage unit 117, and the number of times of transfer Cnt is set to 0.

The driver has driven one or more other vehicles. That is, the actual number of times of transfer is one or more. However, in step S105, the history management unit 116 failed in acquiring the driving history table about the driving history for any reason (for example, not capable of communicating with the server 230, etc.). Therefore, there is no prior diagnosis result data in the history storage unit 117, and the number of times of transfer Cnt is set to 0.

In step S105, one or more driving history table is acquired, and the number of times of transfer Cnt is set to a positive value. However, the prior diagnosis result data in the acquired driving history table is invalid.

In the above-mentioned three cases, the third case is very rare. Therefore, the possibility that the prior diagnosis result is undefined may be considered only in the case in which the number of times of transfer Cnt is 0 as in the first and second cases. Concretely, it is described below.

When the number of times of transfer Cnt is 0, the influence degree Inf(j) is 0 according to the flowchart in FIG. 9. Therefore, in the advice table 307-*j* in FIG. 11, the prior diagnosis result of "undefined" is combined only when the influence degree Inf(j) is 0. That is, when the communication is disabled between the server 230 and the driving diagnosis device 110, a common advice based only on the current diagnosis result (that is, the advice when the prior diagnosis result is undefined) may be substantially presented to the driver.

In some embodiments, the prior diagnosis result of "undefined" may be combined with the case in which the influence degree Inf(j) is other than 0. For example, when the third case above is considered, the number of times of transfer Cnt is set as once or more. Therefore, there is the possibility that a value other than 0 is obtained as a influence degree Inf(j) (refer to FIG. 9). Therefore, advice corresponding to the case in which the prior diagnosis result is undefined may be defined for each combination with each range of diagnosis result Res(j) and influence degree Inf(j) in the advice table.

Furthermore, the seventh embodiment may be varied as follows. For example, an appropriate statistic representing the diagnosis result 6 obtained on each of latest L vehicles in the vehicles the driver has ever driven may be used as a prior diagnosis result in the advice table 307-*j* (where $1<L$). The type (for example, an average value, a mode value, a maximum value, a minimum value, etc.) of the statistic representing the maximum of L diagnosis results 6 is specified depending on the diagnosis item.

For example, when the expression $L=3$ holds true, the judgment unit 118 may notify the advice determination unit 119 of the prior diagnosis result as described below concretely.

When the number of times of transfer Cnt is three or more, the judgment unit 118 reads the diagnosis result 6 on each of the latest three vehicles in the vehicles the driver has ever driven from the driving history tables 304-(Q−3) through 304-(Q−1). Then, the judgment unit 118 calculates a statistic from the three read values, and notifies the advice determination unit 119 of the calculated value as a prior diagnosis result.

When the number of times of transfer Cnt is twice, the judgment unit 118 reads the diagnosis result 6 on the two vehicles the driver has ever driven from the driving history tables 304-(Q−2) through 304-(Q−1) (that is, from the driving history tables 304-1 through 304-2). Then, the judgment unit 118 calculates a statistic from the two read values, and notifies the advice determination unit 119 of the calculated value as a prior diagnosis result.

When the number of times of transfer Cnt is once, the judgment unit 118 reads the diagnosis result 6 on the one vehicle the driver has ever driven from the driving history table 304-(Q−1) (that is, from the driving history table 304-1). Then, the judgment unit 118 notifies the advice determination unit 119 of the read value as a prior diagnosis result.

When the number of times of transfer Cnt is 0, the judgment unit 118 notifies the advice determination unit 119 that the prior diagnosis result is undefined.

The advice determination unit 119 only looks up the advice table 307-*j* at the notification from the judgment unit 118 when the expression $1<L$ holds true. That is, the advice determination unit 119 reads the advice associated with the combination of the following three values from the advice table 307-*j*.

the latest diagnosis result Res(j) notified from the diagnosis unit 115 the influence degree Inf (j) notified from the judgment unit 118 the prior diagnosis result Prev(j) notified from the judgment unit 118

The present invention is not limited to the first through seventh embodiments. In the explanation above, some varied embodiments are described, and further varied embodiments may be generated. The embodiments above and below may be arbitrarily combined so far as they do not contradict one another.

For example, in step S308 in FIG. 9, it is judged whether or not the number of times of transfer Cnt is not less than the threshold CntMax. The judgment is to judge whether or not the definition about the range of CntMax≤Cnt in equation (2) is applied. However, in some embodiments, the three ranges in equation (2) may be defined as Cnt=0, 0<Cnt≤CntMax, and CntMax<Cnt. In this case, in step S308, it is judged whether or not the number of times of transfer Cnt is larger than the threshold CntMax.

Furthermore, in the advice tables illustrated in FIGS. 6 and 11, the range of the influence degree Inf(j) is expressed using a sign of inequality. However, in some embodiments, for example, the range such as m(j)<Inf(j)≤n(j) may obviously be adopted.

FIGS. 5, 6, 10, and 11 exemplify the information in the table format. However, in some embodiments, the data format other than the table format may be used.

Furthermore, in the second embodiment, the vehicle table 302 in FIG. 4 is stored in the vehicle information storage unit 114 in advance. However, the data of the vehicle table 302 may be read from a storage medium and stored in the vehicle information storage unit 114. For example, the data of the vehicle table 302 may be stored in the storage medium 240 as the external device 130, and stored in another storage medium other than the storage medium 240 (for example, a non-volatile memory area in a smart card used as a key for the vehicle 100).

For convenience of explanation below, a field indicating the history information 7 not used in the second embodiment in various types of history information 7 is exemplified in FIG. 5. For example, in the driving history table, the driving time field, the driving start date and time field, and the prior diagnosis result field for each of three diagnosis items are not used in the second embodiment. The field of the history information 7 not used in calculating the influence degree 8 or determining advice may be omitted depending on the embodiments.

Furthermore, an obsolete table not used in calculating the influence degree 8 or determining advice in the vehicle tables 303-1 through 303-P and the driving history tables 304-1 through 304-(Q−1) may be omitted.

For example, assume that the number of times of transfer of a certain driver is 5. In the embodiment in which only the history information 7 about the driving of one latest vehicle is used in calculating the influence degree 8, the data of the vehicle table about other four vehicles the driver has driven before or the driving history table is not used. Therefore, in the embodiments (concretely, for example, the second through fifth embodiments), the history storage unit 117 is not to store an old table. Therefore, in the embodiments, for example, the history management unit 116 may delete the old table from the external device 130 in step S116 in FIG. 7.

In some embodiments, on the other hand, the history information 7 about the two or more vehicles the driver has ever driven may be used in calculating the influence degree 8. For example, in equation (7), the driving time pTime about another vehicle the driver has last driven is used. However, in some embodiments, the judgment unit 118 may calculate the influence degree 8 for the driver who has driven two or more other vehicles before the vehicle 100 based on the driving time of each of the two vehicles driven by the driver immediately before in other vehicles.

The judgment unit 118 may equally evaluate the following tow influences. However, it is preferable that the judgment unit 118 evaluates the influence of the former higher than the influence of the latter, thereby calculating the final influence degree 8.

the influence per hour of driving time from the driving history of the vehicle driven by the driver immediately before the influence per hour of driving time from the driving history of the second latest vehicle driven by the driver Furthermore, when the judgment unit 118 considers the history information 7 about two or more prior vehicles, the judgment in step S307 may be varied as follows. That is, when all vehicle IDs of at most L vehicles (1<L) driven latest by the driver are equal to the vehicle ID read in step S305, the judgment unit 118 may perform the process in step S304 after step S307. On the other hand, when at least one of the vehicle IDs of at most L vehicles driven by the driver immediately before is different from the vehicle ID read in step S305, the judgment unit 118 may perform the process in step S308 after step S307.

In the second embodiment, the number of times of transfer Cnt stored in the statistical table 305 is used in steps S303, S308, and S309. If the driver has driven two or more times the same vehicle, then the number of times of transfer Cnt includes double count for the same vehicle.

However, in some embodiments, the number-of-vehicle information indicating the number of vehicles the driver has driven except the double count for the same vehicle (that is, P indicating the number of the vehicle tables 303-1 through 303-P in FIG. 5) may be stored in the statistical table 305. That is, in step S116, the history management unit 116 may write the number-of-vehicle information indicating the value of P to the statistical table 305.

When the number-of-vehicle information is used, the flowchart in FIG. 9 is varied as follows.

The judgment unit 118 uses the number of times of transfer Cnt in making a judgment in step S303. On the other hand, in steps S308 and S309, the judgment unit 118 uses the number-of-vehicle information. Concretely, the judgment unit 118 may calculate the value od the variable Temp by equation (13) instead of equation (2).

$$\mathrm{Temp} = \begin{cases} 0 & (P = 1) \\ \dfrac{P\mathrm{Max} - P}{P\mathrm{Max}} \times CoefP & (1 < P < P\mathrm{Max}) \\ 0 & (P\mathrm{Max} \le P) \end{cases} \tag{13}$$

The threshold pMax in equation (13) relates to the number (that is, P) of vehicles the driver has ever driven except the double count of the same vehicle. Furthermore, the coefficient CoefP in equation (13) is similar to the coefficient CoefCnt in equation (2).

In the embodiment in which the number-of-vehicle information is used, the judgment unit 118 judges in step S308 whether or not the number of vehicles P is not less than the threshold pMax. If the number of vehicles P is not less than the threshold pMax, the judgment unit 118 performs the process in step S304. On the other hand, is the number of vehicles P is smaller than the threshold pMax, the judgment unit 118 performs the process in step S309. In step S309, the judgment unit 118 calculates the variable Temp by equation (13), calculates the influence degree Inf (j) using the variable Temp, and notifies the advice determination unit 119 of the influence degree Inf(j).

The influence degree Inf (hndl) defined by equations (1) and (13), the influence degree Inf(pos) defined by equations (3) and (13), and the influence degree Inf(acc) defined by equations (4) and (13) are common in the following points.

When the number of vehicles P is 1, the judgment unit 118 judges the influence degree Inf(j) as 0 in step S304.

When the number of vehicles P is larger than 1, as clearly indicated by equation (13), the judgment unit 118 judges the influence degree Inf(j) (in step S304 or step S309) so that the magnitude of the influence degree Inf (j) may monotonically decrease with respect to the number of vehicles P.

Although the above-mentioned number-of-vehicle information is not explicitly used, it is to be noted that the influence degree Inf(j) is judged as 0 in step S304 when the expression P=1 holds true according to the flowchart in FIG. 9 because it is confirmed in step S303 that the number of times of transfer Cnt is 0 when the expression P=1 holds true, or it is confirmed in step S307 that two vehicle IDs are equal.

As explained above with reference to various embodiments above, the judgment unit 118 may use one or more thresholds and/or one or more coefficients for judgment of the influence degree 8. In some embodiments, the judgment unit 118 calculates the influence degree 8 based on the equation not including a coefficient. The judgment unit 118 may calculate the influence degree 8 by an equation including no coefficient.

The threshold and/or coefficient used by the judgment unit 118 may be defined as a constant in a program for realizing the judgment unit 118. Otherwise, a threshold and/or a coefficient may be written in advance to a specified set file stored in the non-volatile storage device 203, and the judgment unit 118 may read a threshold and/or a coefficient from a set file.

A threshold and/or a coefficient may be stored in the storage medium 240 and provided, read through the reader/writer 208, and copied to the specified set file. Furthermore, an administrator of the driving diagnosis device 110 may rewrite a threshold and/or a coefficient in a set file through an input device (or through the network 220 and the WLAN interface 207). An input device may be, for example, a keyboard not illustrated in the attached drawings, but provided for the computer 200. Otherwise, the display 104 may be a touch screen.

In the embodiments in which a threshold and/or a coefficient is updated through the network 220 and the WLAN interface 207, the server 230 performs the learning of the threshold and/or the coefficient.

Concretely, the vehicle information 5 stored in the vehicle information storage unit 114 while the vehicle 100 is running and the diagnosis result 6 obtained from the diagnosis unit 115 while the vehicle 100 is running may be transmitted to the server 230 through the network 220. For example, the history management unit 116 may periodically transmit the vehicle information 5 and the diagnosis result 6 to the server 230. To be more concrete, the history management unit 116 may transmit to the server 230 the vehicle information 5 acquired by the vehicle information acquisition unit 111, for example, once in the latest three minutes, and the diagnosis result 6 obtained from the diagnosis unit 115 in the latest three minutes. Otherwise, the history management unit 116 may collectively transmit to the server 230 the vehicle information 5 and the diagnosis result 6 obtained while the vehicle 100 is running in step S116 in FIG. 7.

Furthermore, the history management unit 116 transmits the vehicle table 302 about the vehicle 100 itself to the server 230. Obviously, the history management unit 116 transmits the history information 7 to the server 230 as explained above with reference to the second embodiment.

The server 230 receives the vehicle information 5, the diagnosis result 6, and the history information 7 as described above from the driving diagnosis device 110 equipped into each of a plurality of vehicles. The server 230 may determine the value of the threshold and/or the coefficient based on the data collected from the driving diagnosis device 110 of a plurality of vehicles. With the lapse of time, the data stored in the server 230 increases.

The server 230 periodically (or irregularly) determines again the value of the threshold and/or coefficient based on the data collected from the driving diagnosis device 110. For example, the server 230 may independently check the influence of the difference in specification between the vehicles on the diagnosis result 6 and the influence of the driving experience of the driver on the diagnosis result 6. The server 230 may check the correlation between the influence of the difference in specification between the vehicles on the diagnosis result 6 and the influence of the driving experience of the driver on the diagnosis result 6. The server 230 may determine the value of the threshold and/or coefficient according to the algorithm of assigning an appropriate function such as the method of least square etc.

The server 230 transmits to the driving diagnosis device 110 through the network 220 the threshold and/or coefficient determined again. Then, each driving diagnosis device 110 receives the new threshold and/or coefficient through the WLAN interface 207, and writes the received value to the set file.

As described above, the update of the threshold and/or coefficient is repeated. Then, with the lapse of time, a more appropriate threshold and/or coefficient is learned by the driving diagnosis device 110. Therefore, as a result of the learning, the appropriateness of the advice presented to the driver is improved with the lapse of time.

Furthermore, since a learning effect is obtained, a detailed preliminary experiment may be omitted. For example, there is no serious problem although a roughly estimated value by the developer of the driving diagnosis device 110 is used as an initial value of the threshold and/or coefficient.

Furthermore, although only a specified test course may be used in a preliminary experiment, or a driving simulator may be used, the learning by the server 230 above is based on the real data. Therefore, it is expected that the threshold and/or coefficient learned as described above are more appropriate than the threshold and/or coefficient obtained from the preliminary experiment.

Also the flowchart in FIG. 7 may also be appropriate varied depending on the embodiments.

For example, step S113 may precede step S110. That is, when a judgment of j≤N is obtained in step S109, then the output control unit 121 may conduct a judgment in step S113.

Then, only when the output control unit 121 judges that advice may be presented to a driver, the diagnosis unit 115 may perform the driving diagnosing process in step S110. In this case, the process in step S111 is performed next. If it is judged in step S111 that the diagnosis has succeeded, then the processes in steps S112 and S114 are performed.

In the flowchart in FIG. 7, the diagnosis unit 115 performs the driving diagnosing process in order on N diagnosis items. However, an event-driven procedure may be used in some embodiments.

For example, when the precondition is satisfied to conduct a diagnosis on the j-th diagnosis item, the output control unit 121 may judge the process in step S113 when the precondition is satisfied. Then, when the output control unit 121 judges that it is possible to present advice to the driver, the diagnosis unit 115 may perform the driving diagnosing process in step S110 on the j-th diagnosis item.

In this case, the process in step S111 is performed next. Then, if the successful diagnosis is judged in step S111, the processes in steps S112 and S114 are performed.

The vehicle information management unit 113 may detect on each diagnosis item whether or not an event that the precondition for the diagnosis has been satisfied has occurred by monitoring the vehicle information 5 output from the vehicle information acquisition unit 111. Depending on the diagnosis items, the vehicle information management unit 113 may detect whether or not an event that the precondition for the diagnosis has been satisfied has occurred by monitoring the lapse of time.

Furthermore, in some embodiments, at least one of plural pieces of advice stored in an advice table may be vacant. For example, on a certain diagnosis item, there is a case in which the magnitude of the influence degree 8 is 0 (or close to 0), and the diagnosis result 6 is assigned a high evaluation. In this case, without presenting any advice, the driver has been well driving the vehicle 100, and there is no warning points to be observed by the driver relating to the influence from the driving experience on other vehicles.

Therefore, in this case, it is rather preferable for the driving diagnosis device 11 to omit presenting advice not to bother the driver by presenting advice. Therefore, there may be association of null advice in particular combinations of the diagnosis result 6 and the influence degree 8 for which presenting advice is to be omitted preferably. The output control unit 121 omits outputting advice when the advice received from the advice determination unit 119 is null.

As described above on various embodiments, each embodiment has the merit that appropriate advice is selected by considering the driving history of a driver. That is, in any embodiment, personalized advice is presented. Therefore, the embodiments are useful in supporting the driving of a driver.

For example, assume that the first and second drivers drive the first and second vehicles respectively. In this case, there is the possibility that the same diagnosis result 6 is obtained occasionally on two drivers. However, according to each of the above-mentioned embodiments, it is possible to present different advice to the first and second drivers depending on the difference in driving history between the first and second drivers.

Furthermore, the first driver afterwards drives the third vehicle. Then, there is the possibility that the diagnosis result 6 obtained at the first time point when the first driver is driving the first vehicle is the same as the diagnosis result 6 obtained at the second time point when the first driver is driving the third vehicle. However, according to each of the above-mentioned embodiments, there is the possibility that different advice is presented to the driver between the first and second time points depending on the storage of the driving history of the first driver.

Furthermore, in any embodiment, it is not judged on a two value basis as to whether or not the diagnosis result 6 is affected by the influence of driving history, but the degree of influence is judged. Therefore, an appropriate piece of advice for each driver may be carefully selected.

As described above, according to each of the embodiments, outputting advice inappropriate, wrong, or unnecessary for a driver may be suppressed, thereby presenting more appropriate advice to a driver. Suppressing the output of inappropriate advice is effective not only in reducing the risk of urging a driver to perform inappropriate driving, but also in preventing a driver from feeling a bother of strange advice.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A driving diagnosis device comprising:

a storage device which stores plural pieces of advice that include plural types of advice for a result of a diagnosis; and a processor which makes a diagnosis on driving by a driver according to vehicle information indicating at least one of behavior of a certain vehicle and an operation of the driver while the driver is driving the certain vehicle;

judges a degree of influence, on the diagnosis, of a driving experience of the driver before the driver drives the certain vehicle according to history information as for a history of the driver driving one or more different vehicles including the certain vehicle; and determines to present, to the driver, a piece of advice corresponding to the judged degree of influence from among the plural types of advice included in the plural pieces of advice stored in the storage device and associated with the result of the diagnosis, wherein the history information includes first vehicle specification information indicating a specification of the certain vehicle, second vehicle specification information indicating a specification of another vehicle other than the certain vehicle in the one or more different vehicles, and ending time information indicating time at which the driver has completed driving the another vehicle other than the certain vehicle, the plural types of advice for the result of the diagnosis include plural types of advice that depend on a degree of positive influence, and plural types of advice that depend on a degree of negative influence, and the processor determines whether influence on the diagnosis is positive or negative according to a difference between the specification indicated by the first vehicle specification information and the specification indicated by the second vehicle specification information, and judges the degree of influence by monotonically decreasing the degree of influence toward zero according to a length of time lapse from the time indicated by the ending time information.

2. The driving diagnosis device according to claim 1, wherein:

the history information includes at least starting time information indicating time at which the driver has started driving the certain vehicle;

the processor judges the degree of influence so that magnitude of the degree of influence monotonically decrease with respect to a length of time lapse from the time indicated by the starting time information.

3. The driving diagnosis device according to claim 1, wherein:

the history information includes at least driving time information indicating a length of time in which the driver drives another vehicle other than the certain vehicle; and the processor judges the degree of influence so that magnitude of the degree of influence monotonically increase with respect to the length of the time indicated by the driving time information.

4. The driving diagnosis device according to claim 1, wherein:

the history information includes at least number-of-vehicle information indicating a number of the one or more vehicles;

the processor judges the degree of influence as zero when the number of vehicles indicated by the number-of-vehicle information is 1;

the processor judges the degree of influence so that the magnitude of the degree of influence monotonically decreases with respect to the number of vehicles indicated by the number-of-vehicle information when the number of vehicles indicated by the number-of-vehicle information is larger than 1.

5. The driving diagnosis device according to claim 1, wherein:

in the storage device, each piece of the plural pieces of advice is stored in association with a combination of the result of the diagnosis, the degree of influence, and a result of a prior diagnosis;

the history information includes the result of the prior diagnosis obtained when the driver drove another vehicle other than the certain vehicle; and the processor determines to present to the driver a piece of advice stored in the storage device in association with a combination of the obtained result of the diagnosis, the judged degree of influence, and the result of the prior diagnosis included in the history information.

6. The driving diagnosis device according to claim 1, further comprising:

a reader which reads the history information from a non-transitory computer-readable storage medium which stores the history information; and a writer which writes the history information as for driving the certain vehicle to the non-transitory computer-readable storage medium.

7. The driving diagnosis device according to claim 1, further comprising:

a receiver which receives the history information over a network from an information storage device; and a transmitter which transmits to the information storage device the history information as for the driving of the certain vehicle over the network.

8. The driving diagnosis device according to claim 1, further comprising an output device which outputs the advice which the processor determined to present.

9. The driving diagnosis device according to claim 8, wherein the processor controls timing of outputting by the output device the advice which the processor determined to present according to the vehicle information.

10. A driving diagnosis system, comprising:

an onboard device equipped into a certain vehicle; and a management device which communicates information with the onboard device over a network, wherein:

the onboard device includes:

a first processor which acquires, from the certain vehicle, vehicle information indicating at least one of behavior of the certain vehicle and an operation of the driver while a driver is driving the certain vehicle; and a first transmitter/receiver which communicates with the management device over the network;

the management device comprises:

a second processor;

a second transmitter/receiver which communicates with the onboard device over the network; and a history storage device which stores first history information as for a history of the driver driving a vehicle other than the certain vehicle;

the onboard device or the management device comprises an advice storage device which stores plural pieces of advice that include plural types of advice for a result of a diagnosis;

the first processor or the second processor makes a judgment on driving of the driver according to the vehicle information;

the first processor or the second processor judges a degree of influence, on the diagnosis, of a driving experience of the driver before the driver driving the certain vehicle according to at least one of the first history information and second history information as for a history of the driver driving the certain vehicle;

the first processor or the second processor determines to present, to the driver, a piece of advice corresponding to the judged degree of influence from among the plural types of advice included in the plural pieces of advice stored in the advice storage device and associated with the result of the diagnosis; wherein the history information includes first vehicle specification information indicating a specification of the certain vehicle, second vehicle specification information indicating a specification of another vehicle other than the certain vehicle in one or more different vehicles, and ending time information indicating time at which the driver has completed driving the another vehicle other than the certain vehicle;

the plural types of advice for the result of the diagnosis include plural types of advice that depend on a degree of positive influence, and plural types of advice that depend on a degree of negative influence; and the first processor or the second processor determines whether influence on the diagnosis is positive or negative according to a difference between the specification indicated by the first vehicle specification information and the specification indicated by the second vehicle specification information, and judges the degree of influence by monotonically decreasing the degree of influence toward zero according to a length of time lapse from the time indicated by the ending time information.

11. The driving diagnosis system according to claim 10, wherein:

the onboard device generates or acquires the second history information, and transmits the second history information from the first transmitter/receiver to the management device over the network; and the management device receives the second history information by the second transmitter/receiver, and adds the received second history information to the first history information stored in the history storage device.

12. The driving diagnosis system according to claim 10, wherein:

the onboard device comprises the advice storage device;

the first processor makes the diagnosis, judges the degree of influence, and determines the advice to be presented to the driver; and the first history information stored in the history storage device is transmitted from the second transmitter/receiver over the network, received by the first transmitter/receiver, and acquired by the first processor.

13. The driving diagnosis driving diagnosis system according to claim 10, wherein:

the management device comprises the advice storage device;

the second processor makes the diagnosis, judges the degree of influence, and determines the advice to be presented to the driver; and the onboard device further comprises an output device which outputs the advice which the second processor determines to present;

the vehicle information acquired by the first processor is transmitted from the first transmitter/receiver over the network, received by the second transmitter/receiver, and acquired by the second processor; and the advice which the second processor determines to present is transmitted from the second transmitter/receiver over the network, received by the first transmitter/receiver, and output from the output device.

14. A driving diagnosis method comprising:

making, by a computer, a diagnosis on driving by a driver according to vehicle information indicating at least one of behavior of a certain vehicle and an operation of the driver while the driver is driving the certain vehicle;

determining, by the computer and according to history information that includes first vehicle specification information indicating a specification of the certain vehicle, second vehicle specification information indicating a specification of another vehicle other than the certain vehicle in one or more different vehicles, and ending time information indicating time at which the driver has completed driving the another vehicle other than the certain vehicle, a difference between the specification indicated by the first vehicle information and the specification indicated by the second vehicle information;

determining, by the computer, whether influence on the diagnosis is positive or negative according to the difference between the specifications;

judging, by the computer, the degree of influence by monotonically decreasing the degree of influence toward zero according to a length of time lapse from the time indicated by the ending time information; and determining, by the computer, to present to the driver a piece of advice corresponding to the judged degree of influence from among plural types of advice included in plural pieces of advice stored in a storage device and associated with the result of the diagnosis, wherein the plural types of advice for the result of the diagnosis include plural types of advice that depend on a degree of positive influence, and plural types of advice that depend on a degree of negative influence.

* * * * *